US008225960B2

(12) United States Patent
Njaastad et al.

(10) Patent No.: US 8,225,960 B2
(45) Date of Patent: Jul. 24, 2012

(54) ICE DISPENSE SYSTEM AND METHOD

(75) Inventors: David K. Njaastad, Palatine, IL (US); Dusan N. Ivancevic, Carol Stream, IL (US); Daniel C. Leaver, Westmont, IL (US); Thaddeus M. Jablonski, Palatine, IL (US); Bassey E. Duke, Birmingham (GB)

(73) Assignee: IMI Cornelius, Inc, Glendale Heights, IL (US)

( * ) Notice: Subject to any disclaimer, the term of this patent is extended or adjusted under 35 U.S.C. 154(b) by 0 days.

(21) Appl. No.: 13/066,660

(22) Filed: Apr. 20, 2011

(65) Prior Publication Data

US 2011/0220689 A1 Sep. 15, 2011

Related U.S. Application Data

(63) Continuation of application No. 11/977,240, filed on Oct. 24, 2007, now abandoned.

(60) Provisional application No. 60/853,856, filed on Oct. 24, 2006.

(51) Int. Cl.
*F25C 5/16* (2006.01)

(52) U.S. Cl. ..... 222/1; 222/639; 222/450; 222/504; 222/146.6; 222/642

(58) Field of Classification Search ..... 222/64, 222/638–643, 63, 1, 504, 146.6; 62/135, 62/137; 193/34
See application file for complete search history.

(56) References Cited

U.S. PATENT DOCUMENTS 2,201,655 A * 5/1940 Srodulski ..... 222/146.5
3,393,839 A * 7/1968 Weil et al. ..... 222/239
3,517,860 A * 6/1970 Whalen ..... 222/202
4,227,377 A * 10/1980 Miller ..... 62/66
4,228,923 A * 10/1980 Barnard ..... 222/52
4,498,607 A * 2/1985 Jaschinski ..... 222/146.6
4,787,539 A * 11/1988 Uchida et al. ..... 222/639
4,803,847 A * 2/1989 Koeneman et al. ..... 62/68
4,817,827 A * 4/1989 Kito et al. ..... 222/238
4,846,381 A * 7/1989 Kito et al. ..... 222/638
4,921,149 A 5/1990 Miller et al.
4,942,979 A * 7/1990 Linstromberg et al. ..... 221/75
5,058,773 A * 10/1991 Brill et al. ..... 222/129.4
5,279,445 A * 1/1994 Fisher et al. ..... 222/1
5,437,391 A * 8/1995 Landers et al. ..... 222/1
6,321,802 B1 * 11/2001 Weeks et al. ..... 141/362
6,607,096 B2 * 8/2003 Glass et al. ..... 222/1
2002/0020711 A1 * 2/2002 Glass et al. ..... 222/1
2006/0277937 A1 * 12/2006 Schlosser et al. ..... 62/344

* cited by examiner

*Primary Examiner* — Kevin P Shaver
*Assistant Examiner* — Donnell Long
(74) *Attorney, Agent, or Firm* — Niro, Haller & Niro

(57) ABSTRACT

An ice dispense system for an ice dispenser is characterized by a chute having an ice receiving upper end in communication with an ice bin outlet passage and an ice dispensing lower end. Beginning with the chute filled with ice and its lower end closed, to dispense a selected quantity of ice, the chute lower end is opened for one of a plurality of different time periods, where each individual time period of the plurality is of a duration to dispense from the chute an associated predetermined quantity of ice. In response to dispensing ice from the chute, an agitator in the bin is operated for one of a plurality of different time periods, where each individual time period of the plurality is of a duration to move through the bin outlet passage and into the upper end of the chute an amount of ice substantially equal to that dispensed. The ice dispensing system is provided with an improved user interface and user programmable features.

8 Claims, 19 Drawing Sheets

ICE DISPENSE SYSTEM AND METHOD

This application is a continuation of application Ser. No. 11/977,240, filed Oct. 24, 2007 and now abandoned, which claimed benefit of provisional application Ser. No. 60/853,856, filed Oct. 24, 2006.

FIELD OF THE INVENTION

The present invention relates to ice dispensing, and in particular to an improved apparatus for and method of dispensing selected quantities of ice.

BACKGROUND OF THE INVENTION

It is known to provide ice dispensers that dispense selected quantities of ice. One such ice dispenser forms the subject matter of U.S. Pat. No. 4,921,149, which is assigned to IMI Cornelius, Inc., the assignee of the present application and the teachings of which patent are specifically incorporated herein by reference. Said patent teaches an ice portion control for an ice dispenser in which a chute has an upper end into which ice is introduced and a lower end from which ice is dispensed. A dispensing gate normally closes the lower end of the chute, and with the chute filled with ice, to vend a desired quantity of ice, the dispensing gate is opened for a selected one of a plurality of timed periods of durations selected to dispense from the chute associated predetermined quantities of ice. Adjusting the durations of the timed periods varies the quantities of ice vended.

In a commercial embodiment of an ice portion control for an ice dispenser embodying the teachings of said U.S. Pat. No. 4,921,149, an ice chute receives ice from a storage bin through a permanently open ice outlet passage in the bin. An agitator in the bin pushes ice from the bin through the passage and into the upper end of the chute to fill the chute with ice, which ice is then dispensed from the chute by controlling an ice outlet opening at a lower end of the chute. When the chute is filled with ice, vending is achieved by opening a gate at the chute lower end for durations of time selected to flow predetermined quantities of ice out of the chute lower opening. The quantity of ice dispensed is determined by the time the gate is maintained open, and the agitator in the bin is operated for a time selected to refill the chute with a quantity of ice generally equal to that dispensed. Programming implemented through electronics with set protocols and values is employed in determining both the time durations of opening of the gate at the lower end of the ice chute for ice dispense and the time durations of operation of the agitator in response to ice dispensing to push ice in the bin through the bin passage and into the upper end of the chute to refill the chute. The ice portion control system employs pneumatics to open the gate at the lower end of the ice chute, while the top of the chute is permanently open and always in communication through the passageway with ice in the bin.

While the concept works well in the commercial embodiment, the ice chute is attached to the dispenser and needs to be removed periodically to provide for cleaning and sanitation. The manner in which the ice chute is attached makes it somewhat difficult to remove and reinstall, as parts of the attachment mechanism are not easily visible and require a service technician to work somewhat blindly. Further, the amount of ice in the chute is not easily viewed by a user, with the result that the user can not determine, before dispensing ice, whether a sufficient amount of ice is available in the chute to satisfy the dispense.

Additionally, as customers often wish to put a lid on a cup into which a drink has been dispensed, cup lid holders were secured to the front of the ice and beverage dispenser. Often attachment of the cup lid holders to the ice and beverage dispenser front face further limited access to and visibility of the ice dispenser, making it more difficult to service the dispenser and view the ice and beverage dispensing operations and limiting customer ability to see what is occurring. While not every ice and beverage dispense was affected, occasionally beverages and/or ice were overflowed or spilled. The result was that the dispenser required more maintenance in order for it and the surrounding area to be keep clean, and also beverages and ice were wasted, which increased costs and reduced profits.

Further, in the commercial version, ice dispense is controlled by a gate that is moved to a closed position and held closed by a spring in an air cylinder, and then opened by application of air pressure to the cylinder. The spring closure is not controllable and on occasion can cause the gate to snap shut, resulting in a pinched finger and possible injury to a user.

OBJECTS OF THE INVENTION

An object of the present invention is to provide an improved ice dispense system for an ice dispenser, which accurately dispenses selected predetermined quantities of ice.

Another object is to provide such an ice dispense system having an ice dispense chute that is easily removable from an ice and beverage dispenser on which it is mounted to facilitate cleaning of both the chute and the ice and beverage dispenser.

A further object is to provide such an ice dispense system having electronics that perform a self-diagnostic test of the system every time it is turned on.

Yet another object is to provide such an ice dispense system that is user programmable to precisely control both the quantities of ice dispensed and the quantities of ice introduced into the ice chute to refill the chute following a dispense.

A yet further object is to provide such an ice dispense system having visual displays to assist a user in programming the system.

A still further object is to provide such an ice dispense system having a gate that is moved between ice chute closing and opening positions by a dual acting pneumatic cylinder that is pneumatically driven in both directions.

A yet further object is to provide such an ice dispense system in which clearance is maintained between a gate that closes a lower end of an ice chute, and in which the force with which the gate is driven to its chute closing position is limited in order to provide safety for a user of the system.

SUMMARY OF THE INVENTION

The present invention provides an ice and beverage dispenser which has a forwardly extending ice chute that is fastened to the dispenser by means that are visible to a user and easily operated. The ice chute has a transparent front cover that allows a user to visually see the amount of ice in the chute, both before and after an ice dispense, and has a diverging shape from top to bottom to ensure that ice traveling through the chute does not jam or stick in the chute. The ice chute and dispenser are constructed so that the ice chute front cover may conveniently, with one hand of a user, be removed from the dispenser for cleaning and then easily replaced. Service and cleaning of the ice chute is much more easily accomplished in a shorter period of time, which is particularly advantageous since regular cleaning of the ice chute is usually mandated by various sanitation codes and regulations.

Additional novel features of the ice portion control system of the invention include the following:

Powering up the unit initiates a self-diagnostic test that interrogates a control circuit and keypad interface for the control circuit. The interrogation checks the state of values stored in a microprocessor and inputs/outputs to and from the control circuit. A keypad interface test interrogates the state of the keypad by checking the open/closed loop resistance values of various button switches on the keypad, and the resistances measured are compared with predetermined resistance valves.

Ice stored in a bin is introduced into an upper end of the ice chute to be dispensed from a lower end of the chute. To ensure a constant and consistent dispense of ice, a relationship is established between the time a gate at the lower end of the ice chute is opened to dispense a predetermined quantity of ice and the time required for an agitator in the ice bin to be operated to push the same predetermined quantity of ice from the bin into the upper end of the ice chute to refill the chute following a dispense of ice. This relationship is a proportional relationship incorporating an integer constant that can be changed by the user through a programming mode in order to accommodate differences in quantities of ice dispensed from the chute and quantities of ice introduced into the chute to refill the chute. Increasing such constant results in an increase in the time spent operating the agitator to push ice from the storage bin into the upper end of the chute to refill the chute, while decreasing the constant decreases agitator operating time and thereby decreases the amount of ice pushed into the upper end of the chute. These adjustments allow the user to compensate for different types of ice that have different dispense flow rates from the bin and through the lower outlet from the chute.

To ensure that the ice dispenser is intuitive and easy to use, it is provided with visual indicators, such as LEDs that accommodate convenient and accurate visual programming of the dispenser. The LEDs are used during programming modes of the ice dispenser to visually inform the user as to predetermined upper and lower limits of programming. Such programming is employed, for example, to set ice chute dispense and ice chute refill times for selected quantities of ice, i.e., to set the various opening times of an ice dispense gate at a lower end of the ice chute and the associated operation times of an ice bin agitator that pushes ice from the bin into the upper end of the chute to refill the chute following an ice dispense. These times can be adjusted based upon a user's specific applications and requirements. Another visual indicator is a service LED that informs the user at any point in time what state the ice dispense unit is in. A further visual indicator is used to inform the user as to what operational mode the ice dispense unit is in, which operational modes may be automatically or manually implemented and are differentiated by specific lighting conventions.

To improve the reliability of an interface by means of which a user initiates a predetermined ice dispense, flat membrane keypad technology is employed. The flat membrane keypad is fully flat and flush for convenient activation by the user. Feedback provided by the keypad is non-tactile and consists of audible noises from the ice dispenser as it operates in response to a keypad input. The flat membrane keypad is submersible, so it may be cleaned without suffering delamination or other damage. The flat membrane keypad works by sensing a change in a resistance value across the keypad upon the user pressing a desired ice portion size button.

The front cover of the ice chute incorporates quick release and indexing tab features that allow the user to use one hand to remove the cover for cleaning. This ensures that the cover can conveniently be removed daily for cleaning, and the quick release and indexing tab features are easy and intuitive to use.

To open and dose an ice dispense gate at a lower ice outlet opening from the ice chute, a pneumatics system is used and incorporates a dual-acting pneumatic cylinder that is activated to both open and close the ice dispense gate. The cylinder is mounted in a horizontal orientation at the lower end of the ice chute, so that any moisture or condensate originating from the ice chute cannot drip onto and run down the rod or nose of the cylinder. To avoid injury to the user, the pneumatic system has a protective cover to protect a user's fingers from accidentally coming into contact with the cylinder. In addition, another safety feature consists of providing the ice dispense gate with a size and configuration so that, when it is closed, a gap exists between it and the ice chute interior to ensure that if the gate closes while the user's fingers are in the lower end of the ice chute, severe damage to the user's fingers will not occur.

As a further safety feature for the pneumatic system, a pressure relief valve is upstream of the air supply to the pneumatic cylinder to prevent the cylinder from exerting a dosing force on the ice dispense gate that is greater than an allowable predetermined closing force, thereby to further mitigate the potential for severe damage to a user's fingers. Also, the pneumatic system is provided with a manual bypass system, so that should the system fail in the dosed position of the ice dispense gate, the user can manually bleed air out of the system and enable the ice dispense unit to be manually operated for continued dispensing of ice to customers.

The ice portion and control system is particularly adapted for use on an ice and beverage dispensing machine to ensure constant and consistent delivery of ice and beverages to customers. The system incorporates unique features that provide a greater ability to conveniently and thoroughly clean the system and an improved ergonomic design to enable better access to beverage valves of the ice/beverage dispenser and the ice chute. Such ergonomic design features include a one piece merchandiser that accommodates attachments to the merchandiser, which attachments can be removed to allow the exposed surface of the merchandiser to be readily cleaned with no dead spots; easier access to and better visibility of the beverage dispensing valves and ice chute with no intrusions; and a visually less intrusive design with a unique front side profile.

Further, as the ice chute and the ice dispense point are more easily viewed by a user, beverage and/or ice dispenses may be made with less spillage and waste and, therefore, greater profit and customer satisfaction.

Ease of service and customer ease of use are increased by a cup lid dispenser which, unlike prior cup lid dispensers, does not obscure the ice and beverage dispense area. To achieve this result, the cup lid dispenser is mounted in front of the dispense area and is angled or sloped from the top downwardly away from the customer, thus increasing his/her view of the ice and beverage dispensing operation. Further, the sloped cup lid dispenser is fastened to the dispenser in a manner that enables it to be easily removed for service and or cleaning of the cup lid dispenser and/or ice and beverage dispenser. The cup lid dispenser is somewhat like that shown in co-pending U.S. patent application Ser. No. 07/204,423, filed Jun. 9, 1988, the teachings of which are specifically incorporated by reference herein.

DESCRIPTION OF THE PREFERRED EMBODIMENT

Figure 1:
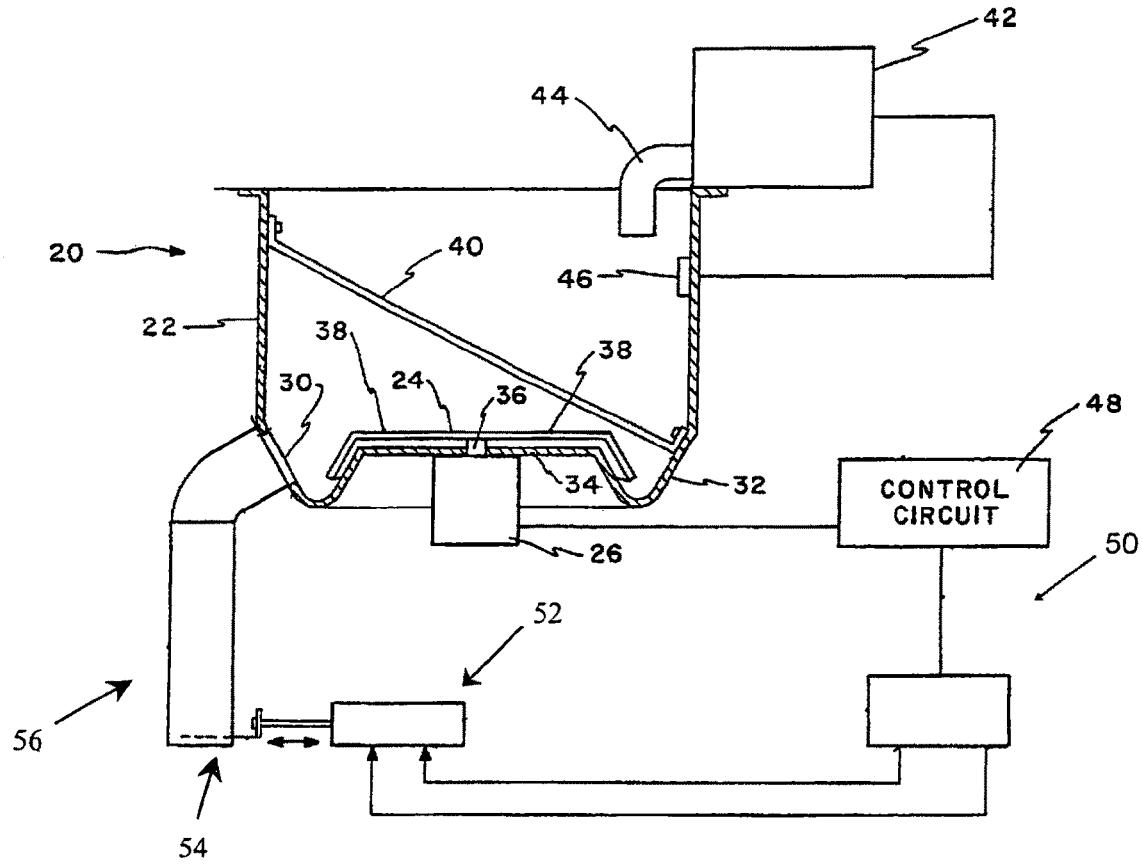
FIG. 1 is a side elevation view, partly in cross section and partly in block diagram form, illustrating an ice dispense system of a type with which the teachings of the invention may be used.

FIG. 1 is a simplified representation of an ice dispenser, indicated generally at 20, of a type with which the teachings of the present invention may advantageously be used. The ice dispenser includes an ice bin 22 for storing a large quantity of crushed, cracked, flaked or cubed ice, a rotary impeller or agitator 24 in the bin and driven by an electric motor 26, and a lower ice outlet passage 30 in the bin accommodating discharge of ice from the bin upon rotation of the agitator. The bottom of the bin may be formed in an annular trough 32 in which the ice discharge passage 30 is formed a short distance above the bottom of the trough, and the trough is provided at its bottom with melt water drain holes (not shown), so that only discrete particles of relatively dry ice move through the passage. The bottom of the bin is closed by an end wall 34, so that ice to be discharged gravitates into and is confined within the trough as it is moved by the agitator 24 to and through the ice outlet passage 30.

The bin bottom wall 34 is centrally apertured for upward, liquid sealed passage of a shaft 36 of the agitator drive motor 26, the motor being mounted on the bottom wall exteriorly of the bin. Carried on the shaft within the bin interior is the agitator 24 which has a plurality of radial arms 38 that generally follow the contour of the bottom wall and extend into the trough and engage the mass of ice in the bin to cause the same to rotate. A rod 40 may optionally be provided and extend from side to side and top to bottom within the bin to provide a fixed resistance against which the rotating mass of ice is moved to facilitate agitation and separation of the ice mass into discrete particles that will readily move through the bin ice discharge passage 30.

Ice may be manually introduced into the bin 22 to fill and refill it. Alternatively, to more conveniently maintain a supply of ice in the bin and automatically replenish ice discharged from the bin, an icemaker 42, having an ice outlet 44 in communication with an upper end of the bin, may optionally be provided. To control the icemaker 42 in a manner to maintain ice at a selected level in the bin, one approach contemplates that a thermostat 46 be on an inside wall of the bin below the icemaker spout 44 and at a level at which ice is to be maintained. The icemaker is operated to produce and introduce ice into the bin in response to signals from the thermostat, such that when the thermostat does not sense the presence of ice around it, the icemaker is operated to produce ice, and when the thermostat senses the presence of ice, the icemaker is turned off. During ice production, the agitator may be periodically operated to level ice introduce by the icemaker into the bin, so that the bin is uniformly filled with ice.

The ice dispenser 20 is for vending ice into cups, the operation of which in doing so will subsequently be described in greater detail. In general terms, the invention provides an improved ice portion control system for the ice dispenser, which operates the ice dispenser in a manner to accurately dispense predetermined quantities of ice, depending on the size of beverage being served. For the purpose, the ice dispenser includes a microprocessor based controller or control circuit 48 that, among other functions performed, controls operation of the agitator motor 26, as well as operation of a pneumatic system, indicated generally at 50, which drives a double acting pneumatic cylinder 52 that opens and closes an ice dispensing gate, indicated generally at 54, at a lower ice outlet opening from an ice chute, indicated generally at 56. An upper open ice inlet opening to the chute communicates with the ice bin outlet passage 30 from the bin 22. When the bin agitator 24 is rotated by the motor 26, it pushes ice through the bin passage 30 into the open upper ice inlet opening to the ice chute 56 to fill the chute with ice, with the amount of ice moved into the chute being dependent upon the time of operation of the agitator. When the pneumatic system 50 operates the pneumatic cylinder 52 to open the ice dispense gate 54, ice is dispensed from the lower ice outlet or discharge opening from the chute, with the amount of ice dispensed being dependent upon the time for which the ice dispense gate is opened.

Figure 3:
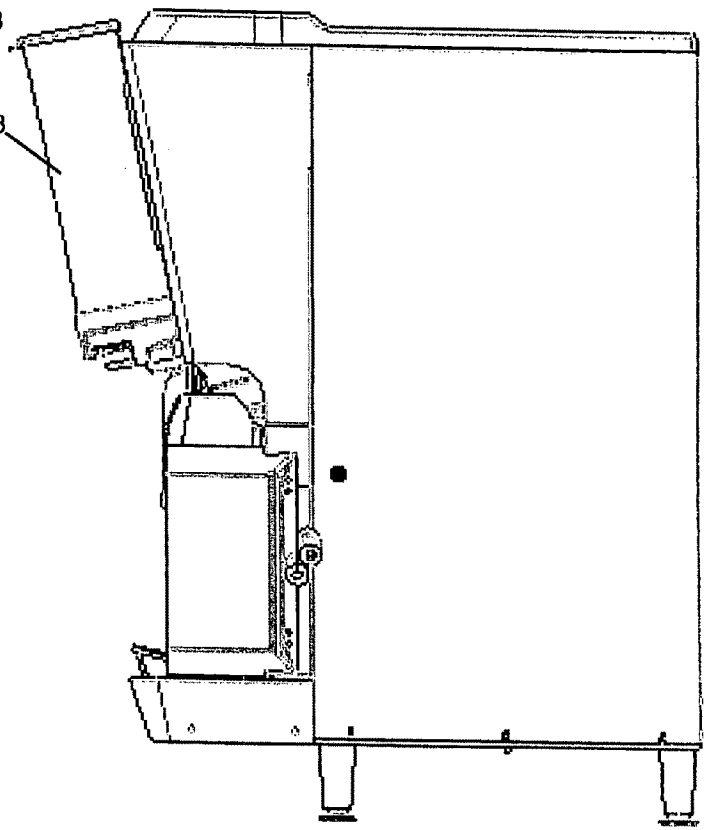
FIG. 3 is a side elevation view of the ice and beverage dispenser of FIG. 2.
Figure 2:
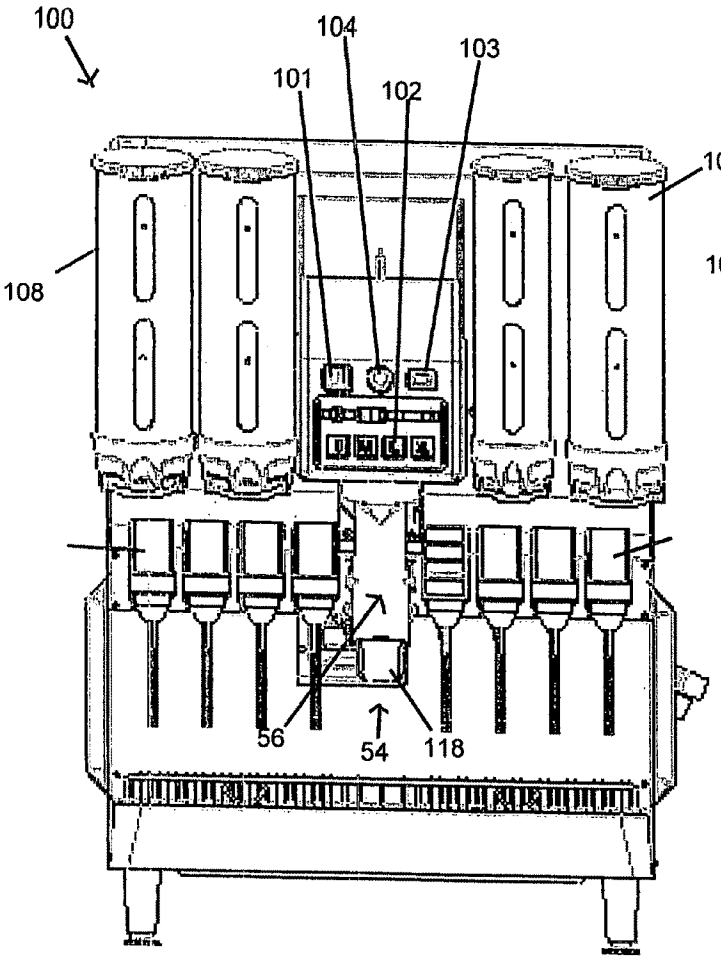
FIG. 2 is a front elevation view of an ice and beverage dispenser embodying an ice dispense system according to the invention.

In the disclosed embodiment, it is intended that a control system provide automatic dispensing of four different selected quantities of ice, although depending upon user requirements, fewer or more than four different selected quantities of ice may be automatically dispensed. As seen in FIGS. 2 and 3, in which an ice and beverage dispenser is indicated generally at 100 and turned off and on by an off/on switch 101, ice portion sizes are selected, and dispensing of ice is initiated, from a flat membrane user actuated switch keypad 102. For each individual ice portion to be dispensed, such as are represented by buttons labeled "S" for small, "M" for medium, "L" for large and "XL" for extra large, the user has the option to program and reprogram the ice dispense cycle or time in order to set the quantity of ice to be dispensed in accordance with the user's particular requirements. Programming the amount of ice dispensed in connection with selection of individual keypad buttons is facilitated through use of visual feedback using an LED meter that is active only in the programming mode. A manual dispense feature that enables the automatic ice portion control system to be bypassed in the event of failure of the control system is provided, with selection between automatic and manual modes of ice dispense being conveniently made by means of a rocker switch 103. When manual dispense mode is selected, dispensing is accomplished by means of a separate lighted push-button switch 104, with dispensing of ice continuing for as long as the push-button switch is actuated. As is seen, the ice dispense chute 56, with its lower ice dispense gate 54, is located generally medially of the front of the ice/beverage dispenser 100, just below the keypad 102 and generally medially between post-mix beverage dispensing valves 106, eight of which are shown, four on each side of the ice dispense chute. Also on the front of the ice/beverage dispenser are four cup lid dispensers 108, two on each side of the keypad.

If it is assumed that the ice chute 56 can be emptied in 410 ms, the controller or control circuit 48 keeps track of the amount of ice left in the chute for any given ice dispense operation. If enough ice is present in the ice chute to satisfy a particular ice dispense, the ice dispense is allowed. While ice is being dispensed the agitator 24 is operated to move ice in the bin through the bin passage 30 and into the open upper end of the ice chute to refill the chute. While the agitator is running, the controller keeps track of how much ice has been put back into the chute. In particular, in response to an ice dispense operation, the motor 26 is energized to operate the agitator 24 for a time duration that refills the chute with an amount of ice in accordance with the amount dispensed, thereby assuring that the ice chute is refilled fully after a dispense. The controller keeps track of the amount of ice in the chute, and if an ice dispense is requested and at the time enough ice is not available in the chute to provide the quantity of ice required, the dispense operation is not allowed until the agitation time calculated to occur before the next dispense is allowed has elapsed, thus ensuring sufficient refilling the ice chute to fully satisfy the dispense operation. The controller uses the time set for the "XL" dispense to calculate the rate at which the ice is replenished, where $T_{XL}$=410 ms.

The ice dispense system of the invention provides for increased speed of service, intuitive and easy to use operation and reliable ice dispenses. Advantageous features of the system include a self-diagnostic test when the system is turned on; a user changeable ratio of ice dispense time versus agitation time, to ensure that the chute is refilled with a proper amount of ice after a dispense operation; a visual programming bar LED to assist a user in programming the system; a service LED to provide a user with a visual indication of system status; a switch allowing a user to selectively change system operation between an automatic ice dispense mode and a manual ice dispense mode; a lighted push-button for operation by a user to dispense ice when the system is in manual mode; and a flat membrane switch keypad operable by a user to dispense selected amounts of ice.

Figure 4:
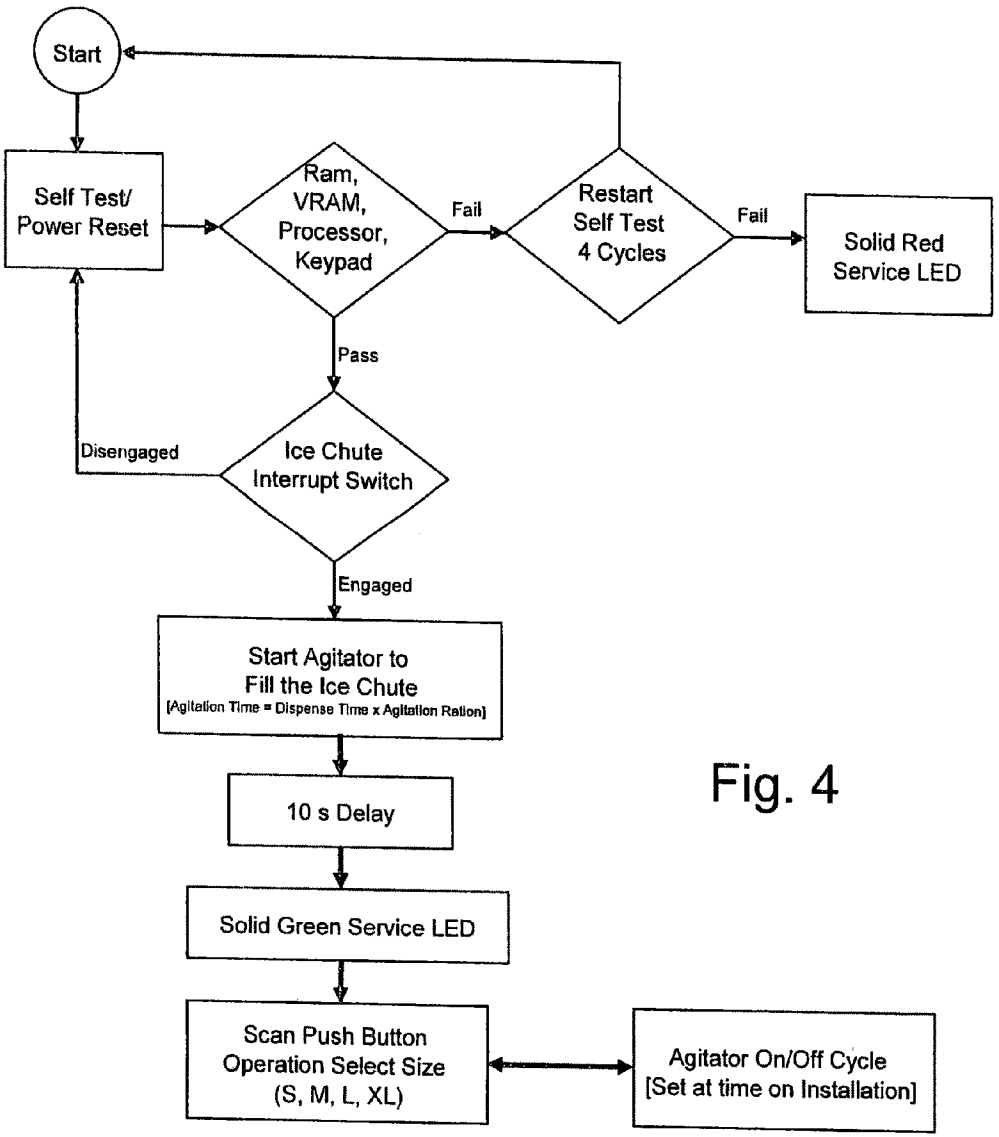
FIG. 4 is a flow chart showing a start-up self-test protocol of the ice dispense system.

Referring to the flow chart of FIG. 4, on powering up the system goes through a set start-up protocol, i.e., a prescribed self-diagnostic test. This protocol involves testing the control circuit 48 and its interface with the keypad 102. During this protocol, a service LED on the portion control board is illuminated red as a visual feedback for the user, to indicate that the system is going though the start-up protocol. The protocol involves an initial self test that interrogates the processor of the control 48. During this interrogation, RAM, VRAM of the processor are checked to ensure that they are at specified states and values. The test then proceeds to check the resistance across all the keys or buttons on the keypad, by measuring open loop resistance value to ensure that it is above a set value. The keypad test is aimed at ensuring that all the keys on the keypad are open and at detecting any electrical shorts on the keys of the keypad. An electrical short on the keys of the keypad would manifest either as a faulty key that will not work or as a key that is permanently dosed and causing a perpetual ice dispense for the affected ice dispense size.

On completion of the self test, the unit proceeds to energize the motor 26 to operate the agitator 24 and move ice in the bin 22 through the bin outlet passage 30 and into the open upper end of the ice chute 56 to fill up the chute with ice prior to a first dispense. The agitation time is based on the "XL" or extra large ice dispense amount setting, and a 10 second delay is introduced for the first ice dispense to give the agitator sufficient time to fill the ice chute before an ice dispense is initiated. On completion of the 10 second delay, the status or results of the self test is displayed through the service LED, such that a red service LED indicates to the user that the ice dispense system failed the self-diagnostic test and that the system requires service, and a green service LED indicates to the user that the system passed the self diagnostic test.

Figure 5:
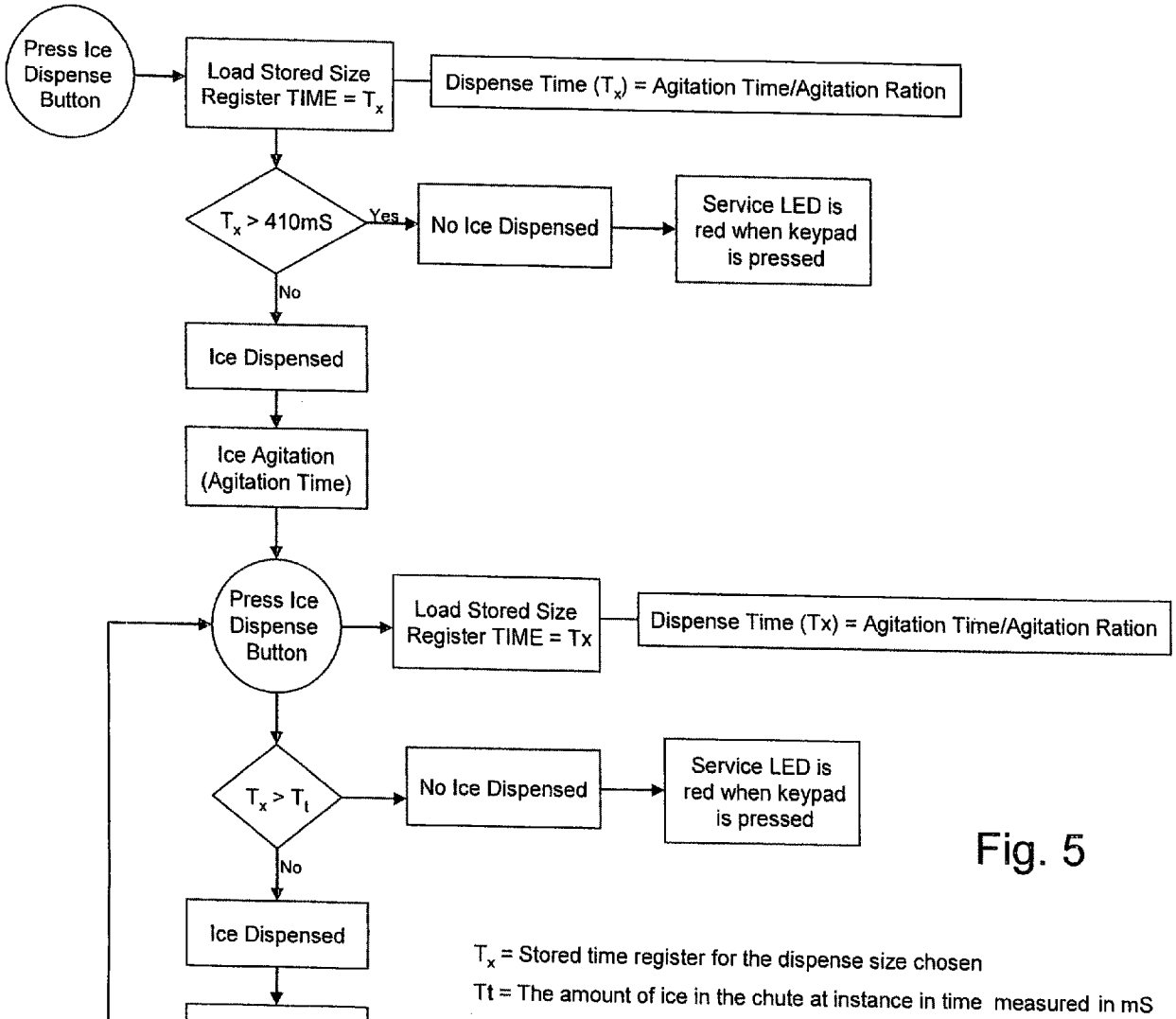
FIG. 5 is a flow chart showing an ice dispense sequence of the ice dispense system.
Figure 6:
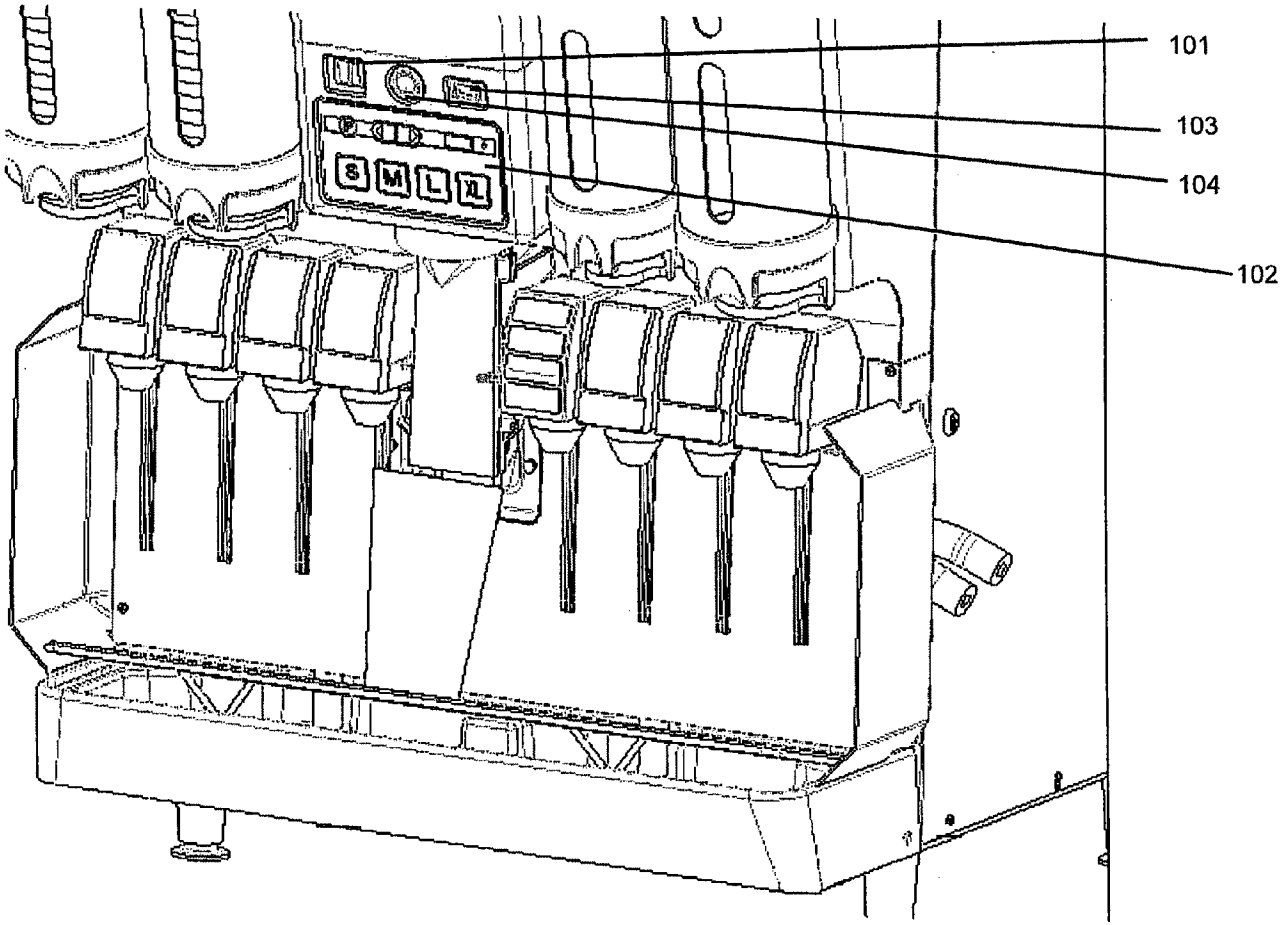
FIG. 6 is a partial front view of the ice and beverage dispenser of FIG. 2, showing the control system as housed in a control box on a front of the dispenser.

After the start up protocol is complete, and with reference to the flow chart of FIG. 5, momentarily pressing an S, M, L or XL button will activate the ice dispensing gate for a pre-programmed dispense time that is in accordance with the particular button pressed. Also, the agitator will be operated for a pre-programmed agitation time that is in a selected ratio relationship with the particular dispense time, i.e., the agitation time is equal to the dispense time multiplied by a selected constant. When the agitation time has lapsed, the unit resumes an off cycle periodic agitation time as set, which prevents the mass of ice in the bin 22 from congealing into a mass of ice. If, following an ice dispense, an ice dispense button on the keypad 102 is pressed for a further size or amount of ice to be dispensed, and if at the time the calculated amount of ice remaining in the ice chute is at least equal to the amount to be dispensed, then an ice dispense will occur. However, if the calculated amount of ice remaining in the ice chute is less than that required for the dispense, the service LED will turn red for as long as the ice portion size button (S, M, L, XL) is pressed, signaling to the user that there is an insufficient amount of ice to satisfy the dispense As will be discussed, the outer cover of the ice chute is transparent, and the amount of ice in the chute is visible to the user. Consequently, if after occurrence of agitation of ice in the bin it is seen that the ice chute is not completely filled with ice, the user has the option of pressing the manual ice dispense button to initiate agitator operation and filling of the ice chute with ice. This feature ensures that the ice chute can manually be filled by the user, if and as necessary, if the set agitation time is incorrect. FIG. 6 shows the manual selection mode switch 103, the manual ice dispense switch 104 and the keypad 102.

Figure 7:
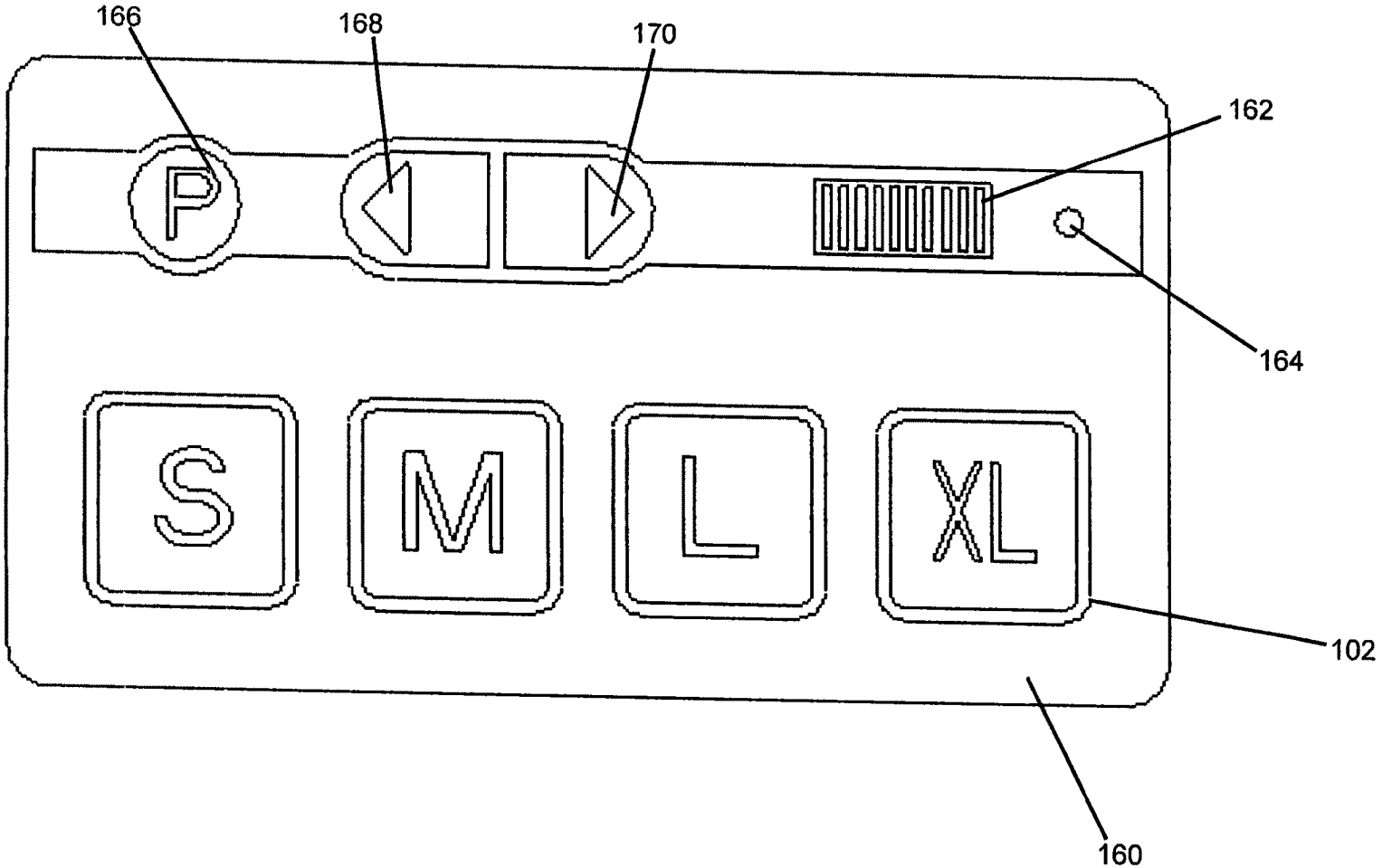
FIG. 7 is an enlarged view of a user programming interface on a front of the control box.

With reference to FIG. 7, ice dispense portion sizes are user selected by the switches S, M, L and XL of the flat membrane keypad switch 102 on a portion control board 160. This board has a 10 LED graduated visual programming bar 162 and a service LED 164. The visual programming bar is used to facilitate the user in setting both the ice dispense time and the time of the agitation that occurs in response to ice dispense to refill the ice chute 56. The user is provided with the ability to adjust the ice dispense time in ms (millisecond) increments and the agitation ratio in numerical increments. The service LED is used as a visual indicator informing the user what state the ice dispense system is in.

The ice dispense time programming mode allows the user to use the 10 LED graduated programming bar 160 to adjust all four ice dispense sizes according to the user's particular requirements. The ice dispense times available through programming, with each graduation on the LED graduated programming bar representing a change of 20 ms, are: (1) Small Ice Dispense/Portion Size (16 oz cup), for which the user can adjust the dispense time in a range from about 50 ms to 230 ms; (2) Medium Ice Dispense/Portion Size (21 oz cup), for which the user can adjust the dispense time in a range from about 80 ms to 260 ms; Large Ice Dispense/Portion Size (32 oz cup), for which the user can adjust the dispense time in a range from about 150 ms to 330 ms; and Extra Large Ice Dispense/Portion Size (42 oz cup), for which the user can adjust the dispense time in a range from about 230 ms to 410 ms. These adjustments enable the user to consistently dispense a required amount of ice for the various cup sizes.

Figure 8:
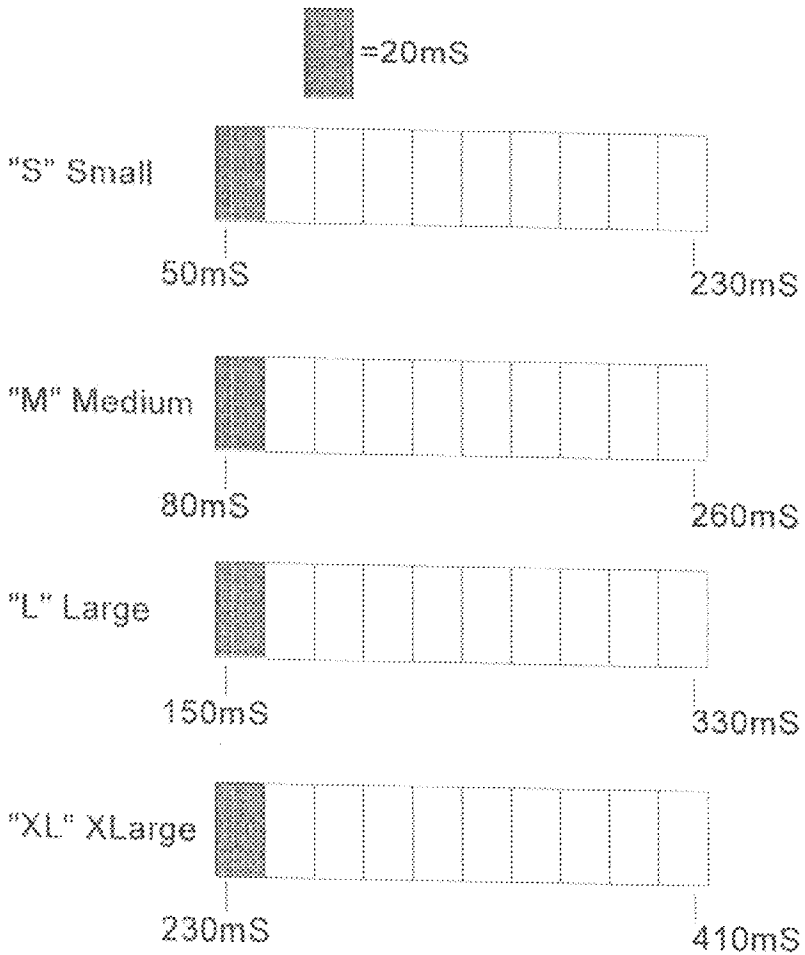
FIG. 8 is a representation of the dispense times available for four different size portions of ice to be dispensed.
Figure 9:
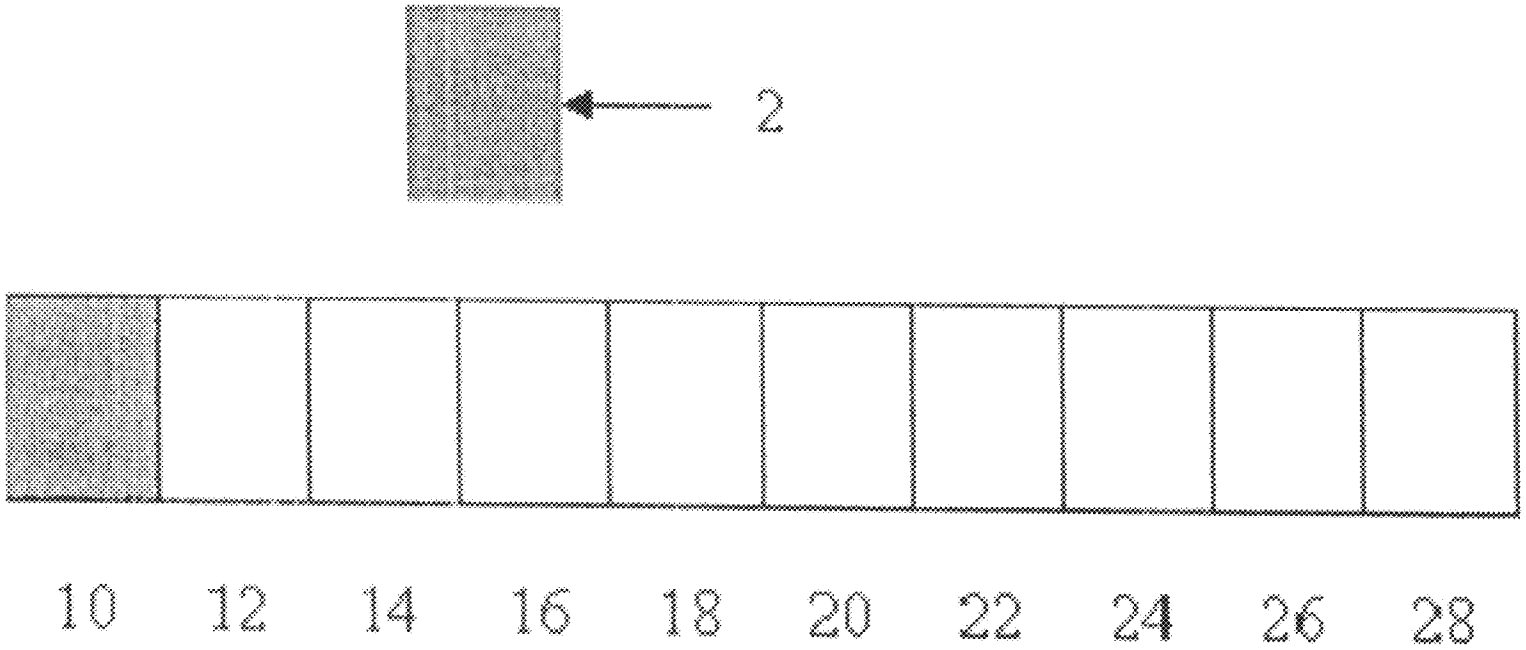
FIG. 9 illustrates an LED programming bar on the programming interface.

FIG. 8 illustrates the above described time bands for each of the four different ice dispense sizes, the time ranges for which are determined based upon different types of ice to be dispensed, e.g., cubes, nuggets, etc., since different ice types have different flow rates through and out of the ice chute and, therefore, different dispense times for given amounts of ice.

Software coding for the ice dispense system involves a direct relationship between ice dispense time and agitation time, which relationship may be expressed as:

$$A_T = D_T \cdot R_A$$

where $A_T$ is the agitation time or the time of operation of the agitator 24 in response to occurrence of an ice dispense; $D_T$ is the time for which the ice dispense occurs and the ice dispense gate 54 is opened; and $R_A$ is the agitation ratio and may be a constant. In other words, when the ice dispense gate 24 is opened for a time $D_T$ to dispense a selected amount of ice from the ice chute 56, in order to refill the ice chute with substantially that same amount of ice, the agitator 24 must be operated for an agitation time $A_T$, which time $A_T$ is directly related to the time $D_T$ and can be expressed as the time $D_T$ multiplied by the relationship ratio $R_A$ between $D_T$ and $A_T$.

The user is given the flexibility to change the agitation ratio $R_A$ in order to change the agitation time $A_T$ that takes place in response to a particular ice dispense time $D_T$. This enables the user to correct for inaccuracies as may exist in refilling the chute, so that the ice chute is always fully filled with ice in response to an ice dispense, and so that the agitator is not operated for significantly longer than is required to refill the chute, for all the different ice types to be dispensed. In other words, the ability of a user to reprogram and change the value of $R_A$ ensures that agitation occurs for the correct amount of time, depending upon the length of dispense $D_T$. This prevents the ice chute from being filled to less than its capacity or ice in the hopper from being overly agitated, resulting in a poor quality of ice dispensed. A user can enter a programming mode and change the agitation ratio by "2" ratio increments per lighted bar graph so that there is an agitation ratio increment from 10 to 28.

Figure 10:
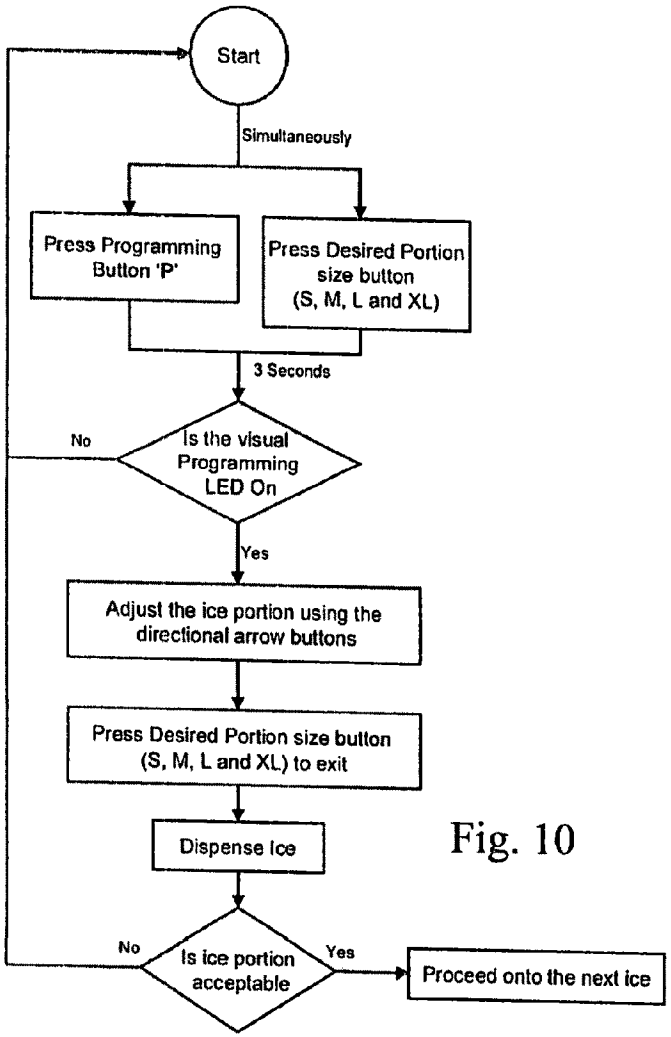
FIG. 10 is a flow chart of the programming mode that enables a user to vary and set the ice portion to be dispensed for each ice dispense size.
Figure 12:
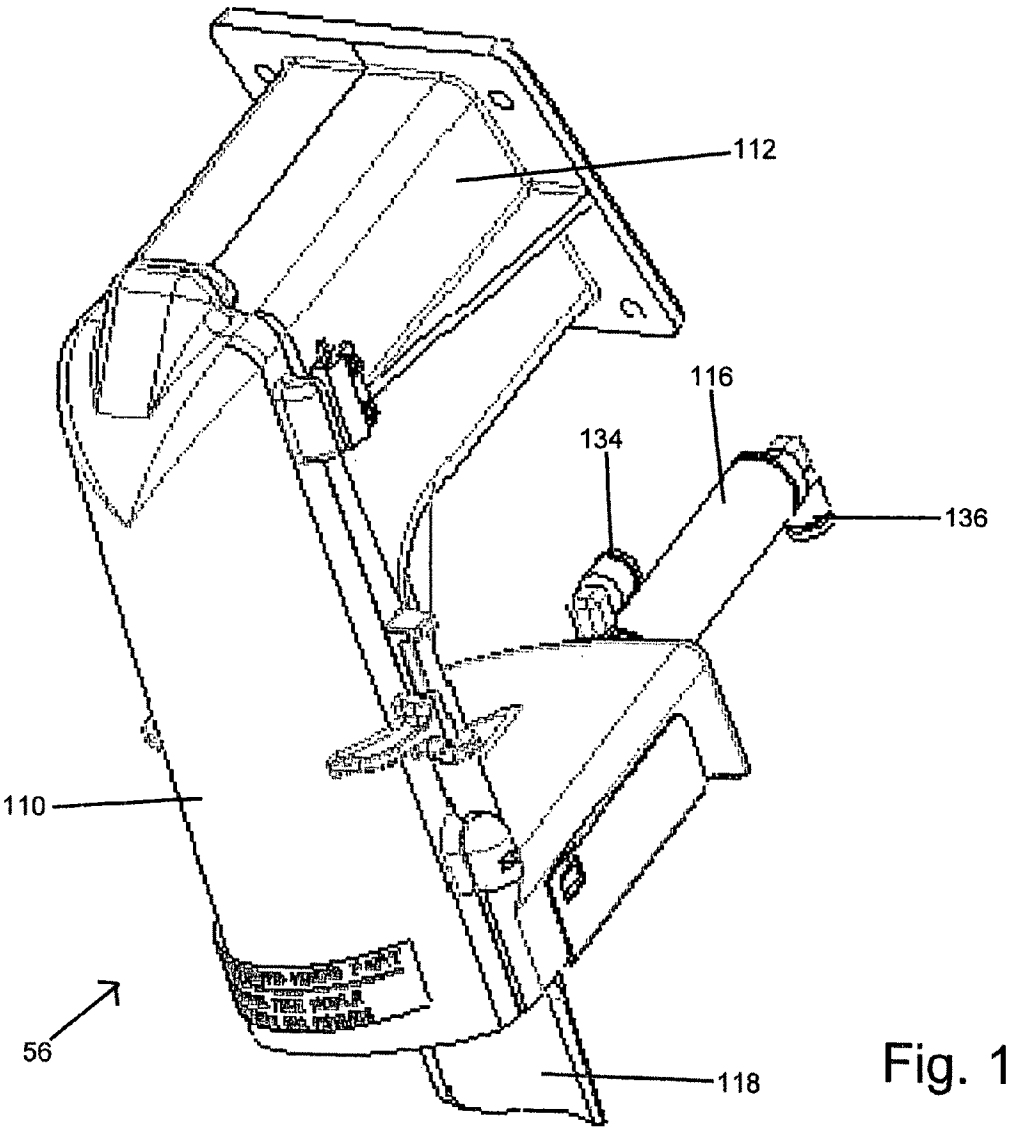
FIG. 12 is a perspective view of the ice dispense chute mechanism.

The ice dispense system has two programming modes, one of which is a dispense time $D_T$ programming mode and the other of which is an agitation time $A_T$ programming mode. With reference to FIGS. 7 and 10, to enter the dispense time programming mode, a user simultaneously presses a programming button 166 and a desired ice portion button S, M. L or XL for 4 seconds. The LEDs of the visual programming bar 162 light up once the ice dispense time programming mode has been entered, indicating to the user the current value of the ice dispense time $D_T$ for the ice portion size button pressed. This is indicated by the number of bars illuminated and the current value of $D_T$ can then be varied by using either of two directional arrow buttons 168 and 170. Pressing the right directional arrow button 170 increases the ice portion for the chosen ice size by increasing the ice dispense time $D_T$ for that size, while pressing the left direction arrow button 168 decreases the ice portion for the chosen ice size by decreasing the ice dispense time $D_T$ for that size. To exit the dispense time programming mode, the user presses the same ice portion button S, M, L or XL as was pressed to enter the programming mode, and the ice dispense portion control time $D_T$ entered for the desired dispense size is then saved in non-volatile memory. While in programming mode, if the user does not press any button for 60 seconds, the control circuit 48 will exit programming mode and return to normal dispensing mode, saving any changes that were made.

Figure 11:
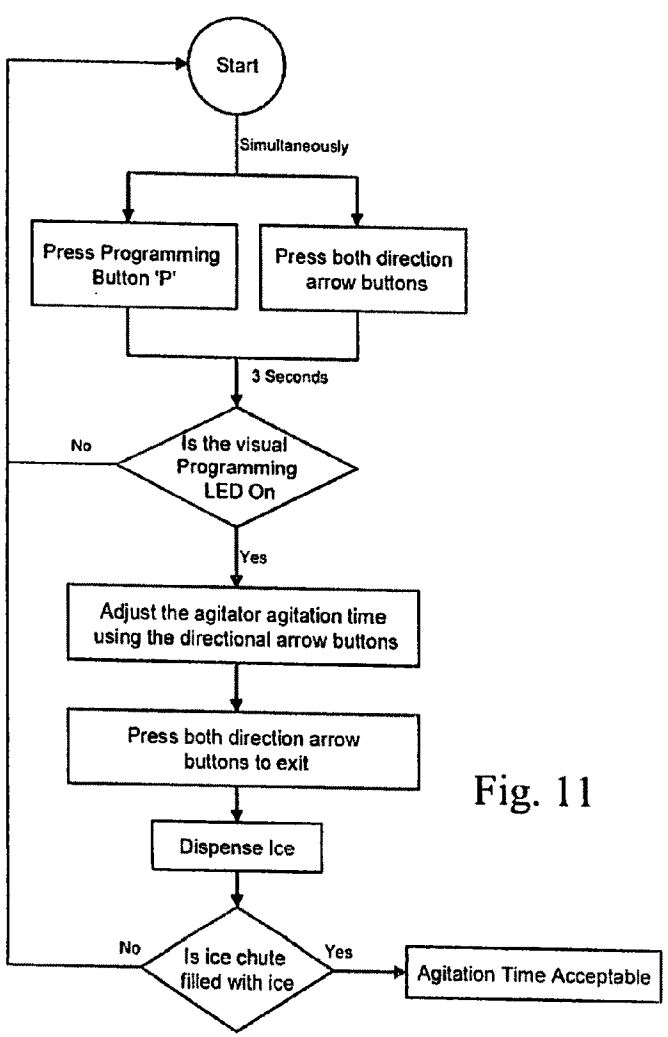
FIG. 11 is a flow chart of the programming mode enabling the user to vary the agitation time to refill the ice chute in response dispensing a selected ice portion size.

To change the time of the agitation that occurs in response to an ice dispense, and with reference to FIGS. 7 and 11, the agitation programming mode is entered. In this mode, the user can increase or decrease, the agitation ratio $R_A$, to change the length of time for which the agitator is operated to refill the ice chute in response to an ice dispense. This accommodates changes in agitation time necessitated by all the different ice types that may be dispensed and that have varying dispense rates from the bin 22 into, through and out of the ice chute 56. This mode may be entered by simultaneously pressing and holding, for 3 seconds, all of the programming button 166 and both direction arrow buttons 168 and 170. When the agitation programming mode is entered, the LED visual programming bar meter 162 turns on to provide visual feedback of the then existing agitation ratio, which enables the user to vary the agitation time using the directional arrow buttons to change the agitation ratio $R_A$. Pressing the left arrow button 168 decreases, and pressing the right arrow button 170 increases, the agitation ratio.

Ice dispenses are initiated by pressing a selected portion size button S, M. L or XL on the flat membrane keypad 102. The keypad is contemplated to be non-tactile and that the feedback received by the user be audible when ice is being released from the ice chute 56 into a cup or container. The keypad consists of varying layers which are adhered together, resulting in a liquid repellant keypad. Due to the environment in which the ice and beverage dispensing unit is located, there will be instances of beverage and food splashing onto the unit and cleaning fluids being used to clean the unit. There is, therefore, a need to have a robust keypad design to meet the day to day environment in which the unit is located, and the keypad 102 meets that criteria. The keypad works by sensing a change in resistance value across the keys. By depressing each key, the user changes this resistance value, resulting in an ice dispense. The keypad advantageously incorporates texts or letters, as opposed to symbols, to inform the user which button is to be pressed to dispense a particular ice portion size. The effective area of the buttons is relatively large to increase keypad button targeting.

All low voltage circuits are all located in the controller 48. The mains power on/off switch also is located in the controller, and the systems modes of automatic and manual are controlled by the controller. In addition, the portion control system is controlled by the controller, and for the purpose of visual feedback in manual mode, the manual ice dispense push-button switch 104 is lighted, and the service LED 164 is switched off, to indicate to the user that the unit is in manual mode. In automatic mode, the service LED lights to inform the user that the ice dispense system is in automatic mode.

The ice chute 56 is shown in FIG. 12-15 and is configured to allow ease of cleaning and to provide increased safety for, and positive visual feedback to, the user. Features of the ice chute include a front ice chute cover 110 that is easily removable from an ice chute body 112 to provide a construction that accommodates easy cleaning of the ice chute; positive visual feedback to a user by virtue of the chute cover 110 being of a transparent polycarbonate material, so that a user might see the amount of ice in the chute; further visual feedback to a user by virtue of latches for coupling the chute cover to the chute body being readily visible to the user; clearance between the lower interior wall of the ice chute and a mechanical gate 114 that is pneumatically moved into a lower end of the chute to close the chute (see FIG. 14), so that a user's finger(s), if inside the chute when the gate closes, will not be severely crushed; a dual acting pneumatic cylinder 116 for moving the gate at the lower end of the chute between its open and closed positions; a relief valve to prevent excess pressure in the pneumatic system; a manual bypass valve to allow manual operation of the ice dispense gate should the pneumatic system fail; a cup rest 118 on the ice chute; a cylinder angle mounting for the pneumatic cylinder 116 that places the cylinder horizontally to prevent melt water and condensate from the chute 56 from flowing onto and along the cylinder; a shield that, for safety, blocks user access to the pneumatic cylinder 116 in the area where the gate exits the rearward side of the ice chute; and a diverging ice chute design, such that an interior ice flow path through the chute generally increases in cross-sectional area from top to bottom, to prevent jamming or blockage of ice in the chute.

Figure 13:
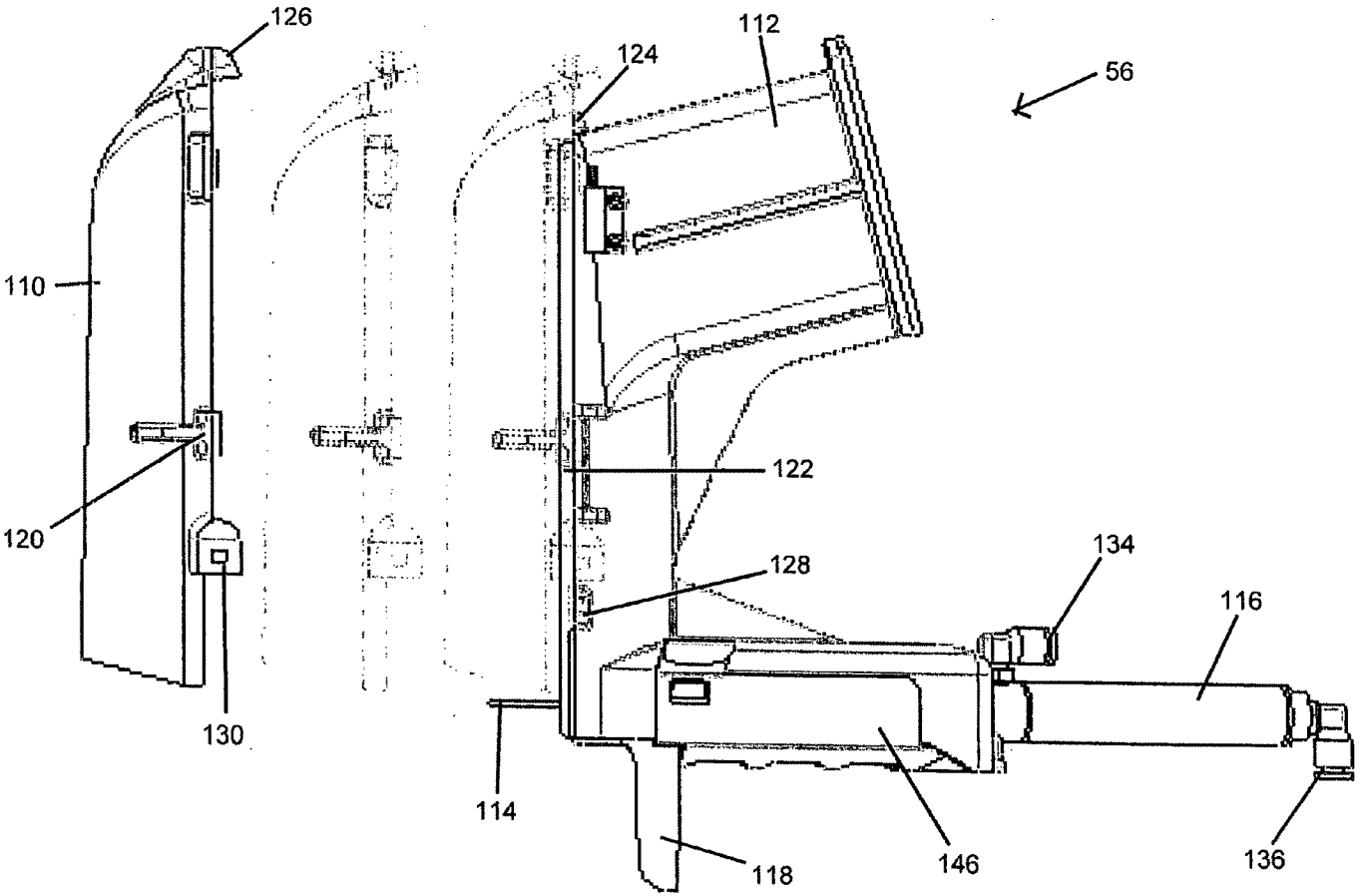
FIG. 13 is a side elevation assembly view showing the manner in which a cover of the ice dispense chute mechanism can be removed from and replaced on a body of the mechanism.
Figure 14:
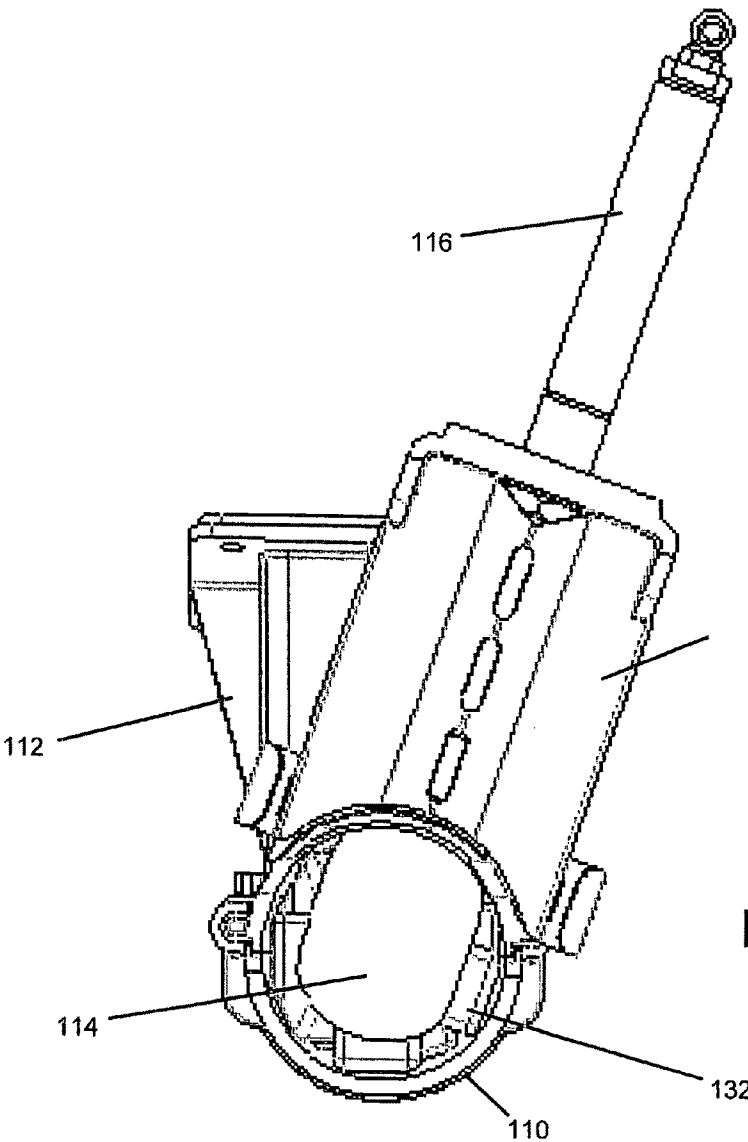
FIG. 14 is a bottom view of the ice dispense chute mechanism, particularly showing a clearance maintained between a lower interior of the ice chute and a gate that moves into and out of the chute.
Figure 15:
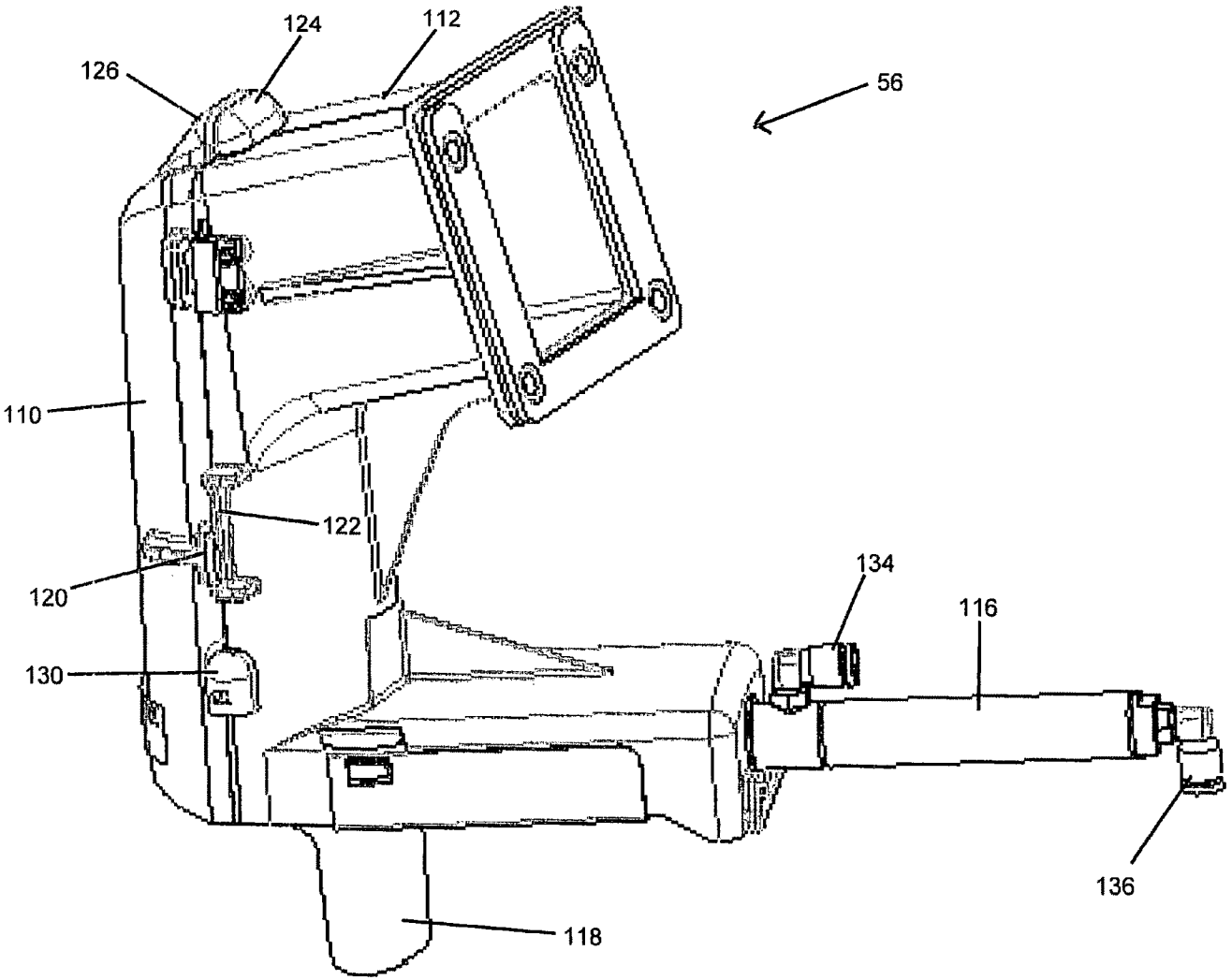
FIG. 15 is a perspective side elevation view of the ice dispense chute mechanism.

The ice chute 56 is designed for ease of removal of the cover 110 from the chute body 112. This enables the internal surfaces of the ice chute to readily be exposed for daily cleaning. With particular reference to FIGS. 13 and 15, the ice chute incorporates an indexing and locking feature that enables the user to easily use just one hand to remove the cover 110 from the body 112 by simply lifting the cover relative to the body and then pulling it away from the body, and to then replace the cover on the body by lining up indexing tabs on the cover with the body and then moving the cover downward along the body. This indexing and locking is accomplished by providing a pair of index tabs 120 on opposite sides of the ice chute cover 110, and by providing an associated pair of vertically extending tab receiving areas 122 on opposite sides of the ice chute body 112. The arrangement is such that with the cover moved against the body, the cover can be vertically moved or slid downward along the body to move the cover index tabs into the body tab receiving areas to conveniently mount the cover on the body, or the cover can be vertically moved or slid upward along the body to move or slide the cover index tabs out of the body tab receiving areas to conveniently remove the cover from the body. In addition, the body is provided with a side-to-side extending tab 124 at its upper end, which tab is received in a slot in an upper rearward extension 126 of the cover when the cover is mounted on the body. In addition, toward its lower end the body 112 is provided with a pair of vertically extending tabs 128 that move into and are received in slots formed in a pair of outward extensions 130 of the cover 110 when the cover is mounted on the body, and that move out of the extension slots when the cover is removed from the body. To remove the cover, upon gripping it with one hand, the user lifts it relative to and along the body 112 to move the cover index tabs 120 along and out of the body tab receiving areas 122, to move the body tabs 128 out of the slots in the cover extensions 130, and to move the cover extension 126 away from the body tab 124, which releases the cover from the body. To replace the cover on the body, the user positions it on the front of the body and then slides the cover downward along the body to move the cover tabs 120 into the body tab receiving areas 122, to move the body tabs 128 into the slots in the cover extensions 130, and to move the cover extension 126 over the body tab 124, to thereby releasably mount the chute cover 110 on the chute body 112.

As mentioned, the ice chute cover 110 is visually transparent, and advantageously the ice chute body 112 is made of a black plastics material to provide a black background for better visualization of ice in the chute, so that the user has a clear view of the amount of ice in the chute. This enables the user to readily determine whether there is sufficient ice in the chute to satisfy an ice dispense. The mounting of the ice chute 56 on the ice/beverage dispenser 100 also places the ice chute in a position to better facilitate visual observation by the user as to how much ice is present in the ice chute The mechanical chute gate 114 and the interior of the lower end of the chute 56 are configured and dimensioned so that a gap 132 (FIG. 14) exists around the gate when it is extended into the lower end of the chute by the pneumatic cylinder 116 to close the chute and terminate ice dispense. This provides a safety feature, in that when the gate is closed a minimum clearance gap is provided around the ice chute gate to minimize the occurrence of injury to a user should his finger(s) be in the chute lower end upon closure of the gate. The gap also limits the impact of a closing gate on a user's finger(s).

Figure 16:
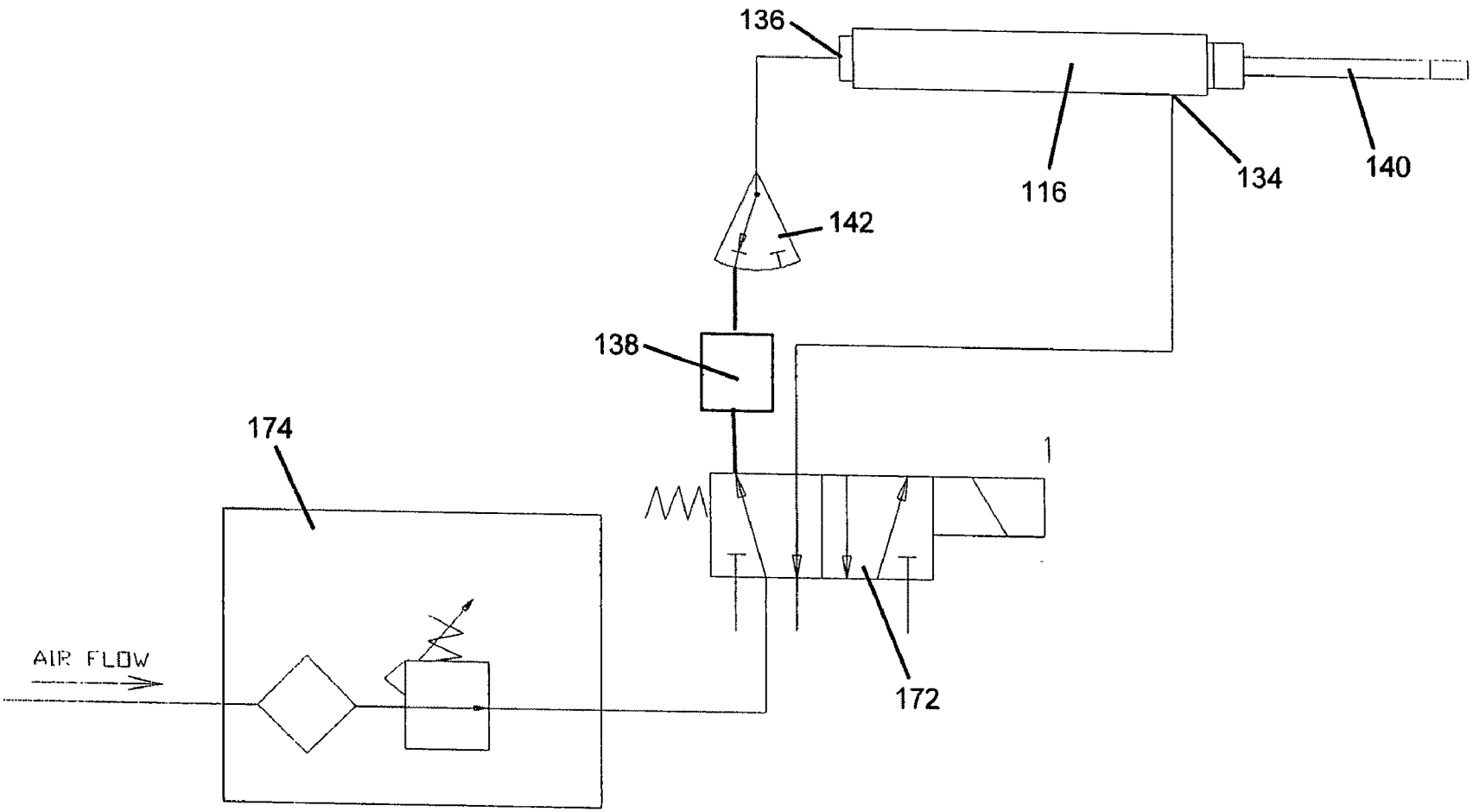
FIG. 16 is a schematic of a pneumatic control system for operating a pneumatic cylinder that drives an ice dispense gate of the ice chute.
Figure 17:
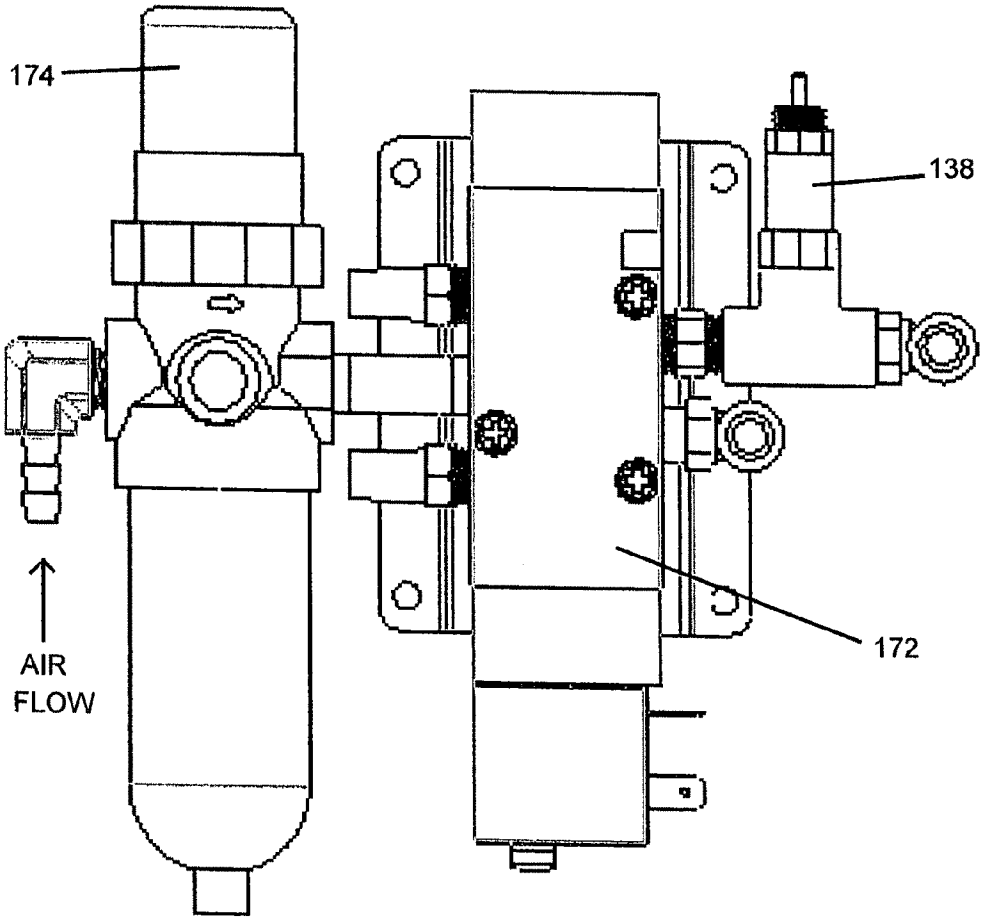
FIG. 17 is a pictorial representation of the pneumatic control system with a pressure relief valve at an outlet from the pneumatic control system.
Figure 18:
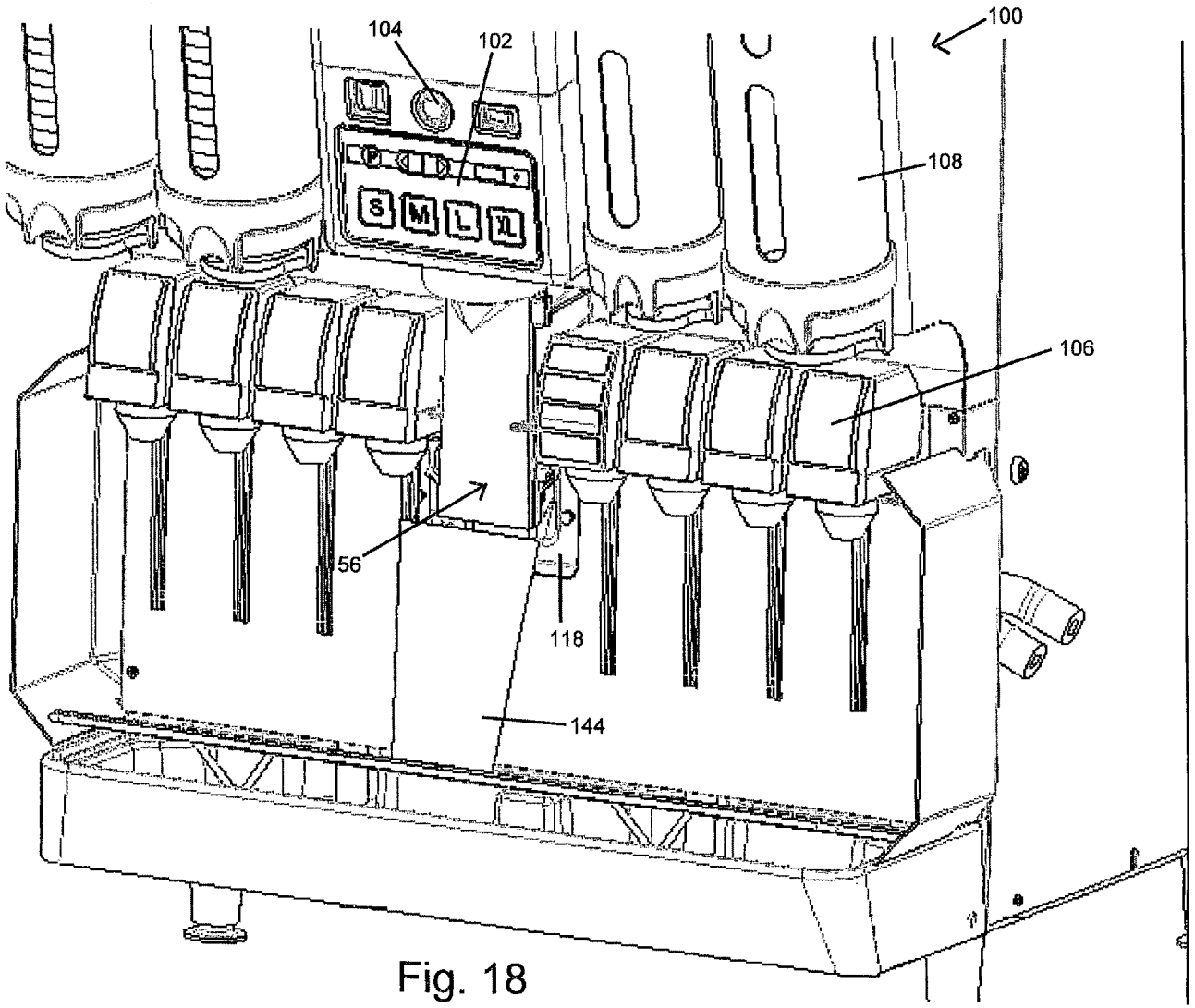
FIG. 18 illustrates a cup rest of the ice and beverage dispenser and the manner in which the cup rest supports a cup against tipping over during an ice dispense operation.

With reference also to FIGS. 16 and 17, the pneumatic cylinder 116 is a dual-acting cylinder, such that pressurized air is supplied to an air inlet 134 to the cylinder to move the chute gate 114 rearward to open the lower ice discharge end of the ice chute 56 to dispense ice, and pressurized air is supplied to an air inlet 136 to the cylinder to move the chute gate forward to close the lower end of the chute to terminate ice dispense. The use of a dual-acting cylinder provides a more positive closure of the chute gate and improves upon the prior design that utilized a spring to return the cylinder to the closed position and close the gate. The pneumatic cylinder advantageously incorporates a plastic bearing and an anodized cylinder nose to reduce the effect of corrosion on the cylinder and improve its life expectancy.

The default position of the chute gate 114 is closed, where the gate is extended into and remains in the lower end of the ice chute, to ensure that if there is a failure of the ice dispense system, the ice chute gate will remain closed and ice will not be or continue to be dispensed from the chute. As a further safety feature, a relief valve 138 is upstream of the pneumatic cylinder 116 in the air line that provides pressurized air to the air inlet 136 to the cylinder. The relief valve prevents excess air pressure, for example air at a pressure above about 40 psi, from reaching the cylinder in order to prevent the cylinder from exerting excessive closing forces on the chute gate 114 via a piston rod 140 of the cylinder, thereby to further limit any harm to the user should his finger be in the lower end of the ice chute when the gate closes. To enable the cylinder to vent in either its open or closed position, it is contemplated that the system use a 5/2 pneumatic solenoid valve 172 that receives air through a filter/regulator 174, to control the pneumatic cylinder.

Also for safety purposes, a manually operated bypass valve 142 is upstream from the pneumatic cylinder 116 in the air line that provides pressurized air to the cylinder air inlet 136. The bypass valve permits the user to bypass incoming pressurized air to the cylinder air inlet 136, thereby removing the gate closing force of the pressurized air on the cylinder. The arrangement ensures that if the cylinder, pneumatics or electronics are faulty, the pressurized air that is applied to the cylinder to close the chute gate 114 can be removed to enable the user to manually open the ice chute gate.

The new ice chute design incorporates the cup rest 118 (FIGS. 12, 13, 15 and 18) to locate and support a cup 144 underneath the ice exiting the chute 56 during ice dispense, thereby to prevent the cup from tipping over. The cup rest serves as a locating feature to guide the operator in placing a cup directly underneath the lower outlet opening from the ice chute 56 and to prevent tipping over of, or spillage from, a cup during ice dispense.

Figure 19:
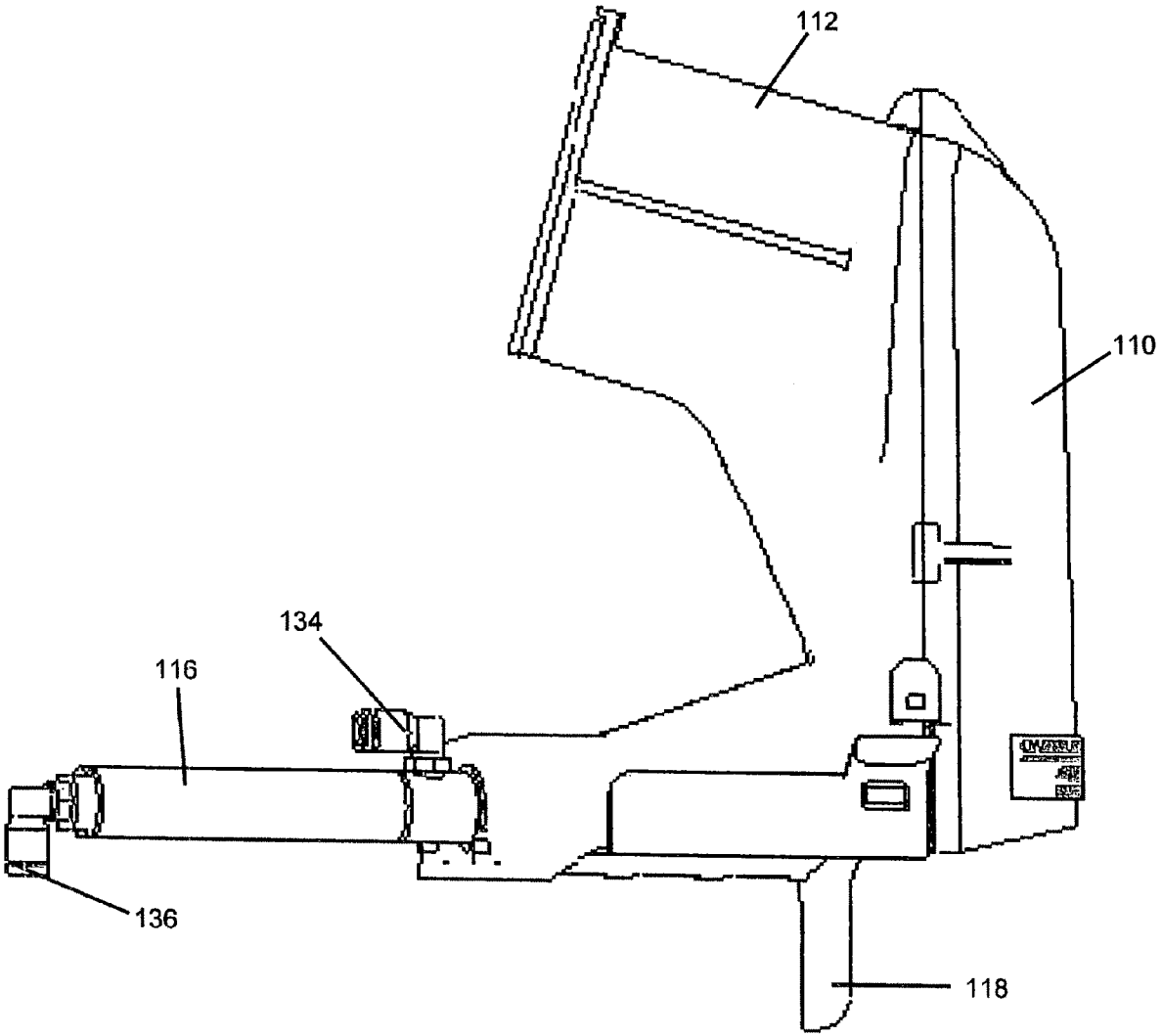
FIG. 19 is a side elevation view of the ice chute mechanism, showing a pneumatic cylinder of the mechanism mounted horizontally so as not to be contacted by melt water and condensate running of the ice dispense chute.

As seen in FIG. 19, the dual-acting pneumatic cylinder 116 extends horizontally, as compared with lying at an angle on the order of 20° as is the case for some prior designs. The arrangement prevents melt water and condensate from the ice chute 56 from running onto and along the cylinder.

Figure 20B:
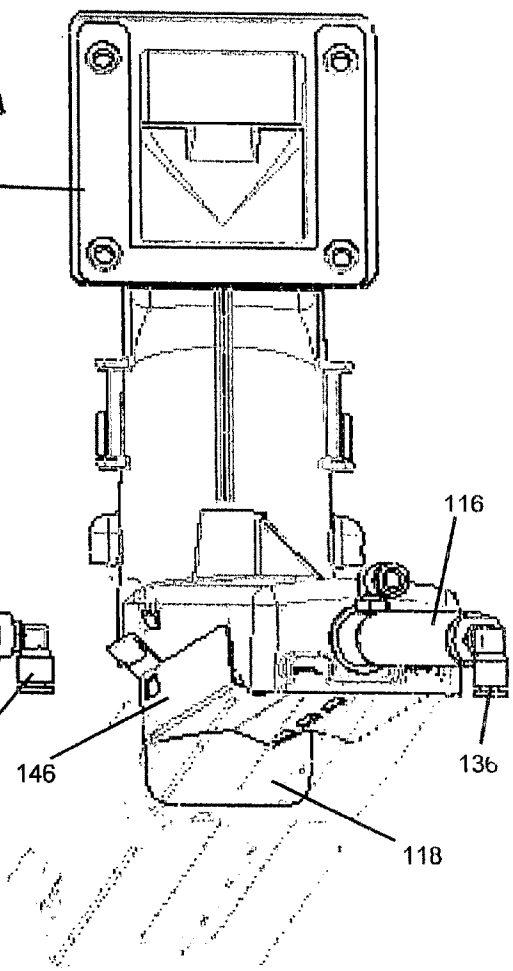
FIGS. 20A and 20B show a cover for the pneumatic cylinder of the ice dispense chute for limiting user access to the cylinder for safety purposes.
Figure 20A:
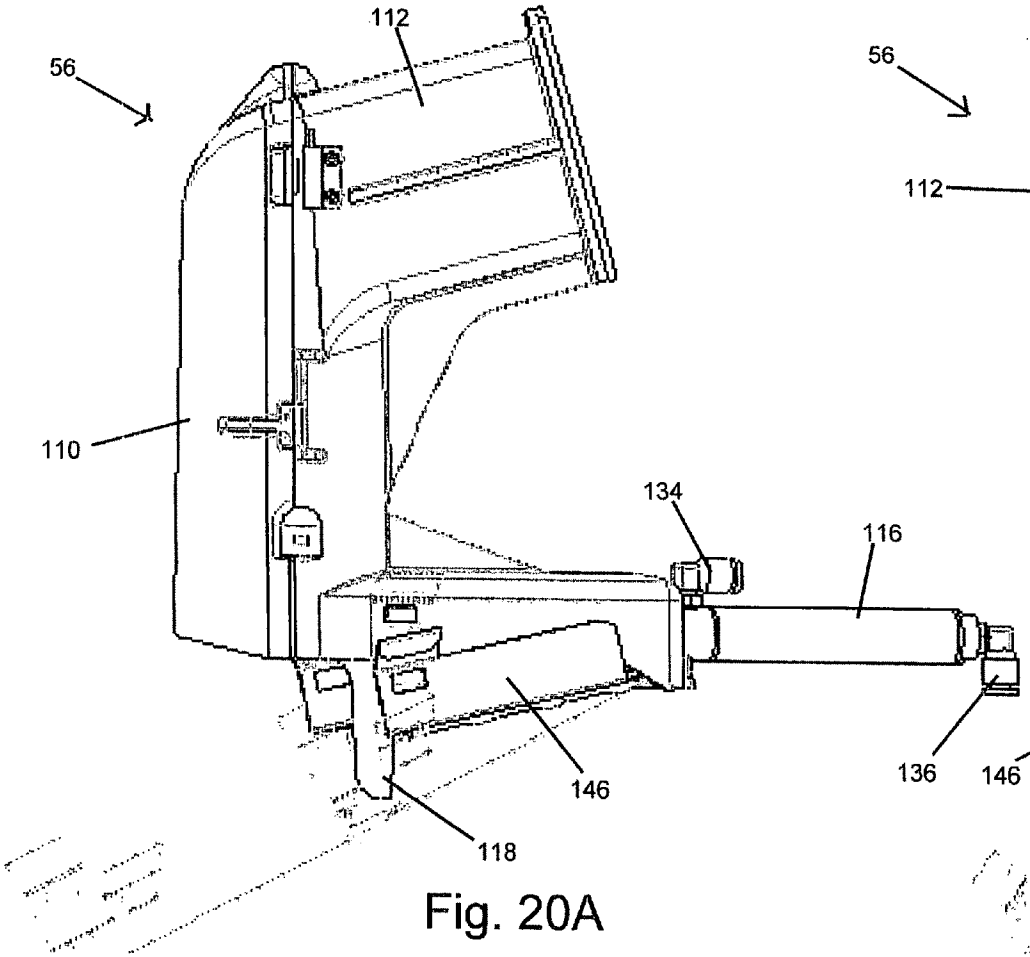

As seen in FIGS. 20A and 20B, an ice chute cylinder cover 146 fits underneath the ice chute 56 to prevent a user from accidentally coming into contact with the dual-acting pneumatic cylinder 116 and its rod 140 and chute gate 114.

Figure 21:
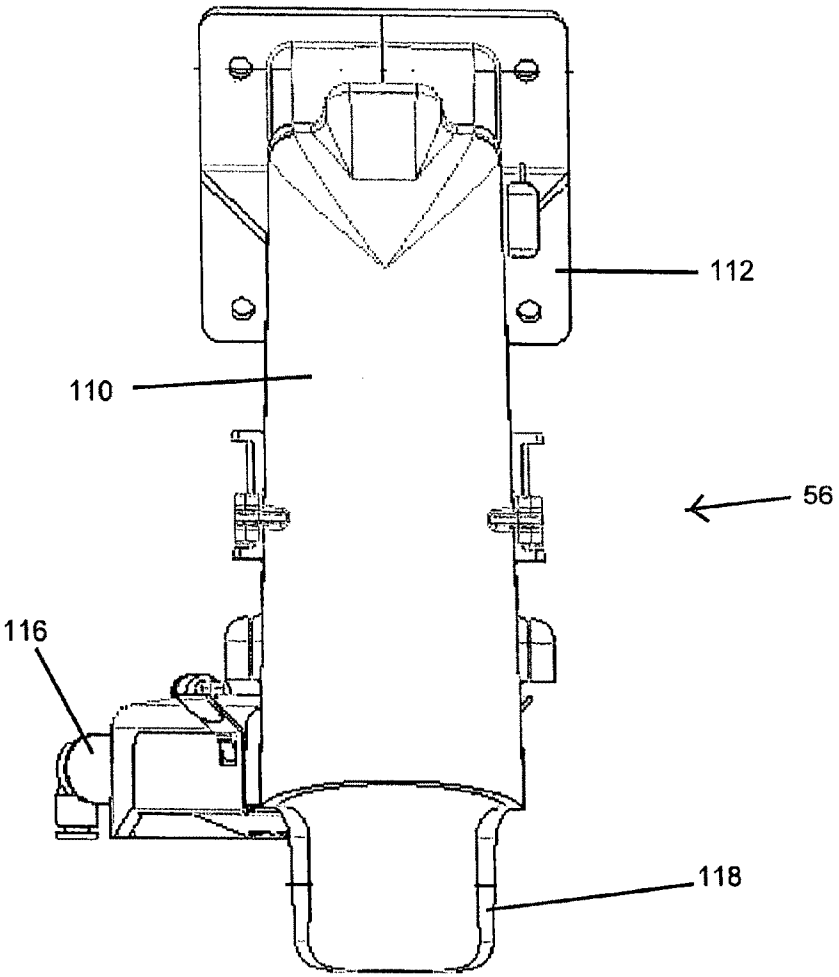
FIG. 21 illustrates a diverging configuration of the ice chute from top to bottom to prevent jamming of ice passing through the chute.

As seen in FIG. 21, an ice flow path through the ice chute 56 diverges outward in a continuously increasing cross-sectional area of the ice flow path, from the upper to the lower end of the chute, to prevent ice from becoming trapped in the chute as it flows downward through the chute.

The ice portion and control system is particularly adapted to be used on an ice and beverage dispensing unit to ensure a constant and consistent delivery of ice and beverage to an end user. The system incorporates unique features that enable a higher degree of cleanliness than the prior design, together with improved ergonomics to enable better access to beverage valves and the ice chute. These unique features include a one piece merchandiser that allows removable attachments to be made to it, such as cup lid dispensers that can be removably attached to the merchandiser in a manner to accommodate their convenient removal for cleaning of both the cup lid dispensers and merchandiser surfaces, and that that can then readily be reattached to the merchandiser. The ergonomics of the system accommodate improved and easier access by a user to the beverage dispensing valves and ice chute, without interference from intrusions, thereby providing better visibility of the beverage valves and ice chute.

While embodiments of the invention have been described in detail, various modifications and other embodiments thereof may be devised by one skilled in the art without departing from the spirit and scope of the invention, as defined in the appended claims.

What is claimed is:

1. A method of dispensing ice from an ice bin having an ice outlet and an agitator for moving ice in the bin through the outlet and into an upper ice inlet to an ice dispense chute having an ice flow path extending between its inlet and a normally closed lower ice outlet from the chute, said method comprising the steps of:

dispensing a selected quantity of ice from the chute by opening the chute outlet for a selected one of a plurality of different dispense times to dispense from the chute a quantity of ice in accordance with the duration of the dispense time for which the chute outlet is opened;

refilling the chute with ice, in response to performance of said dispensing step, by operating the bin agitator for a refill time having a duration determined by the dispense time and during and throughout which refill time a quantity of ice substantially equal to the quantity dispensed is moved through the bin outlet and into the inlet to the chute;

monitoring, using a controller, the quantity of ice dispensed from the chute in performance of said dispensing step and the quantity of ice introduced into the chute during performance of said refilling step;

determining, using the controller, the quantity of ice present in the chute at any given time during performance of said dispensing and refilling steps; and inhibiting, using the controller, performance of a subsequent ice dispensing step until said determining step determines that the quantity of ice in the chute is at least equal to the quantity of ice to be dispensed.

2. A method as in claim 1, wherein said determining step determines the quantity of ice in the chute at any given time by comparing the monitored quantity of ice dispensed from the chute to the monitored quantity of ice refilled into the chute up to such given time.

3. A method as in claim 1, wherein said refilling step operates the bin agitator for a refill time directly related to the dispense time for which said dispensing step is performed.

4. A method as in claim 1, including the step of using the controller to adjust individual ones of the plurality of different dispense times.

5. A method as in claim 1, wherein said refilling step operates the bin agitator for a refill time proportionate to the dispense time for which said dispensing step is performed.

6. A method as in claim 1, wherein said refilling step operates the agitator for a time equal to the dispense time for which said dispensing step is performed as multiplied by the value of a constant, and including the step of using the controller to adjust the value of the constant.

7. A method as in claim 1, including the step of using the controller to adjust the relationship between the time of performance of a refilling step and the time of performance of a dispensing step in response to which the refilling step is performed, such that the duration of the refilling step is such as to cause substantially the same quantity of ice to be refilled into the chute over the duration of the refilling step as is dispensed from the chute.

8. A method as in claim 1, including the step of permitting a user to operate the controller to control performance of each of said dispensing and refilling steps in order to continuously dispense ice for as long as the user desires.

* * * * *